United States Patent [19]

Nowak

[11] 4,379,499

[45] Apr. 12, 1983

[54] EMERGENCY POWER ELEVATOR RECOVERY AND SERVICE SYSTEM

[75] Inventor: Frederick H. Nowak, Southington, Conn.

[73] Assignee: Otis Elevator Company, Farmington, Conn.

[21] Appl. No.: 280,843

[22] Filed: Jul. 6, 1981

[51] Int. Cl.[3] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 2,968,364 | 1/1961 | Robertson | 187/29 R |
| 3,506,095 | 4/1970 | Weaver | 187/29 R |
| 3,706,357 | 12/1972 | Simpson | 187/29 R |

FOREIGN PATENT DOCUMENTS

| | | | |
|---|---|---|---|
| 54-17246 | 2/1979 | Japan | 187/29 R |

*Primary Examiner*—B. Dobeck

*Assistant Examiner*—W. E. Duncanson, Jr.

*Attorney, Agent, or Firm*—M. P. Williams

[57] ABSTRACT

A multi-elevator system operable in response to a group controller (FIG. 1) operates in a first phase (FIG. 9) in which each car is selected in a sequence to be run in a first phase (FIG. 4) in which each car is commanded to run to a designated landing (FIGS. 5 and 6). When an attempt has been made to recover all cars (30, FIG. 9; 22, FIG. 8), a second attempt is made, if necessary (28, FIG. 9; 11, 13, 15, FIG. 8). Then, in a second phase, cars are selected on a priority basis in which the highest level are cars with firemen in them or cars not at a designated landing (8, FIG. 10). A second priority level includes cars designated as preferred by the customer (22, FIG. 10) and a third level includes any available car (29, FIG. 10). Any car not recovered is caused to become available (10, FIG. 3) for selection (8, FIG. 10) on a periodic basis, the priority level section automatically deselecting one of the service cars for operation so as to permit selecting the unrecovered car for operation.

10 Claims, 10 Drawing Figures

EMERGENCY POWER ELEVATOR RECOVERY AND SERVICE SYSTEM

DESCRIPTION

1. Technical Field

This invention relates to elevator systems, and more particularly to improvements in recovering elevators to designated landings and designating elevators to provide service to the building, on emergency power, following loss of normal building power.

2. Background Art

It has long been the practice, particularly in high rise buildings having many floors, to provide a source of emergency power for operating elevators when normal building power, supplied by feeders, fails. The emergency power may be battery power or more likely power supplied by generators run by fueled engines. In the usual case, the emergency power supply will be inadequate to provide power for all of the elevators in a particular group of elevators, so that elevators must be selected to run on emergency power, one or several at a time (depending upon the elevator-capacity of the emergency power supply).

When power fails, it is, in the normal case, quite likely that some of the elevator cars will have passengers therein. Therefore, the current practice has been to provide for operation of elevator systems under emergency power in two phases. In a first phase, the elevator cars are selected one (or more, depending upon capacity) at a time and directed to be recovered to a designated return landing. The designated return landing, in a simple case of loss of power, may be the main lobby. The purpose of this initial recovery phase is to control with precision the minimum required motion and operation of each elevator so as to permit passengers in all of the elevators to leave the cars. If the cars were allowed to continue to run in order to deliver their present passengers, other passengers may enter and prolong the process. Thus, delivering the passengers of one or two cars could cause passengers trapped in three or four other cars to remain trapped for many minutes, or indefinitely. In the second phase of operation, once it is known that all of the cars have returned to the designated landing so that their passengers could escape, one or more cars are designated to provide limited service (ordinary service, but utilizing only the one or two elevators which the emergency power system has the capacity to run at one time).

In systems known to the art, provision is made for manual control during emergency power conditions as well as for automatic group control during emergency power conditions. In the manual mode, a building elevator service supervisor would operate switches on a main lobby panel (or the like) to select which elevators are to run, and to first command the selected elevators to return to the designated landing. Thereafter, the operator would cause one or two elevators to be operative, and shut the remaining elevators off so that normal operation could resume with the selected one or more elevators. In automatic systems, a group controller selects the elevators, in turn, to be recovered to the designated landing, and then selects elevators to provide normal, but curtailed service after each elevator has had an opportunity to be recovered to the designated landing.

In many cases, the loss of normal building power may be accompanied by other electrical control problems.

Also, conditions in any one car may prevent it from responding to an attempt to recover the car to the designated landing (such as maintenance personnel blocking a door open). Thus, during phase one operation, it is common that one or more cars may not respond and may not initially be recovered to the designated landing.

In systems known to the prior art, once an attempt has been made to recover a car to a designated landing, if the car has not responded (referred to herein as emergency start delayed), the elevator is (in a sense) considered to be "lost", and not recoverable. The rescue of passengers in non-responding elevators must be effected by other means (i.e., intervention by service personnel). Even in manual systems, the only way in which an unrecovered car may be reselected in an attempt to recover it is to interrupt operation of one of the cars when it is at the recovery landing (such as at the main lobby and in view of the operating personnel) so that one of the cars providing normal but curtailed service can be taken off of the emergency power system to permit re-trying the recovery attempt.

DISCLOSURE OF INVENTION

Objects of the invention include provision of improvements in emergency power elevator recovery and service systems, including prolonging phase one recovery attempts whenever less than all cars are initially recovered, provision for repeated attempts to recover elevators initially delayed in a recovery process, and priority protocols for the selection of cars to be run, either in repetitive recover attempts or in the provision of building service, during the second phase of emergency power operations.

According to the present invention, an elevator system having a group controller operable automatically upon the loss of building power to control the selection of as many elevators as can run on emergency power provides, during a second phase after an attempt has been made to recover all cars, operation of a number of selected cars to provide passenger service in the building with periodic attempt to recover any cars not previously recovered. According to another aspect of the invention, the selection of cars to run on emergency power during a second phase after an attempt has been made to recover all cars, is accomplished on a priority basis in which the highest level of priority for selection of cars includes those cars determined to not be at a designated return landing. According to the invention, the selection of cars with a highest priority level including cars not at the return landing automatically provides priority to periodic re-trying to recover cars previously not recovered. According to an aspect of this invention still further, a second priority level includes cars designated as preferred to be run on emergency power; and a third level includes any cars which are available to run. According to yet another aspect of the invention, early recovery of as many cars as possible following the loss of normal power is achieved by first attempting to recover each of the cars followed by a recycle in which a second attempt is made to recover any cars not recovered during the first attempt, prior to transferring operation to a second phase in which passenger service is provided by selected cars.

The invention provides the greatest opportunity for ultimately recovering all of the cars after loss of normal building power, whereby passengers can escape from cars without intervention of maintenance personnel. The invention provides early escape in most cases by making at least two attempts to recover each car (if necessary) before devoting the limited emergency power resource to providing limited passenger service in the building. The invention enhances the ultimate desired operation on emergency power by providing an automatic priority system wherein initially cars on firemen service or not at a designated landing are given the highest priority, cars designated as preferred to be run on emergency power are given a second level of priority, and any other car whch can run is given lowest priority. Thus, any car may first be designated to run during the second phase for the provision of passenger service, but when a car more preferred becomes available to run, the first car will be dropped from selection so as to permit selection of a preferred car. And, any car not yet recovered automatically becomes a priority car by periodically forcing its delayed status to be reset so as to look eligible for running in view of its highest priority status, since it is not yet at the designated return landing.

The invention may be implemented in a variety of fashions utilizing apparatus and techniques which are well within the skill of the art in the light of the teachings which follow hereinafter. The foregoing and other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
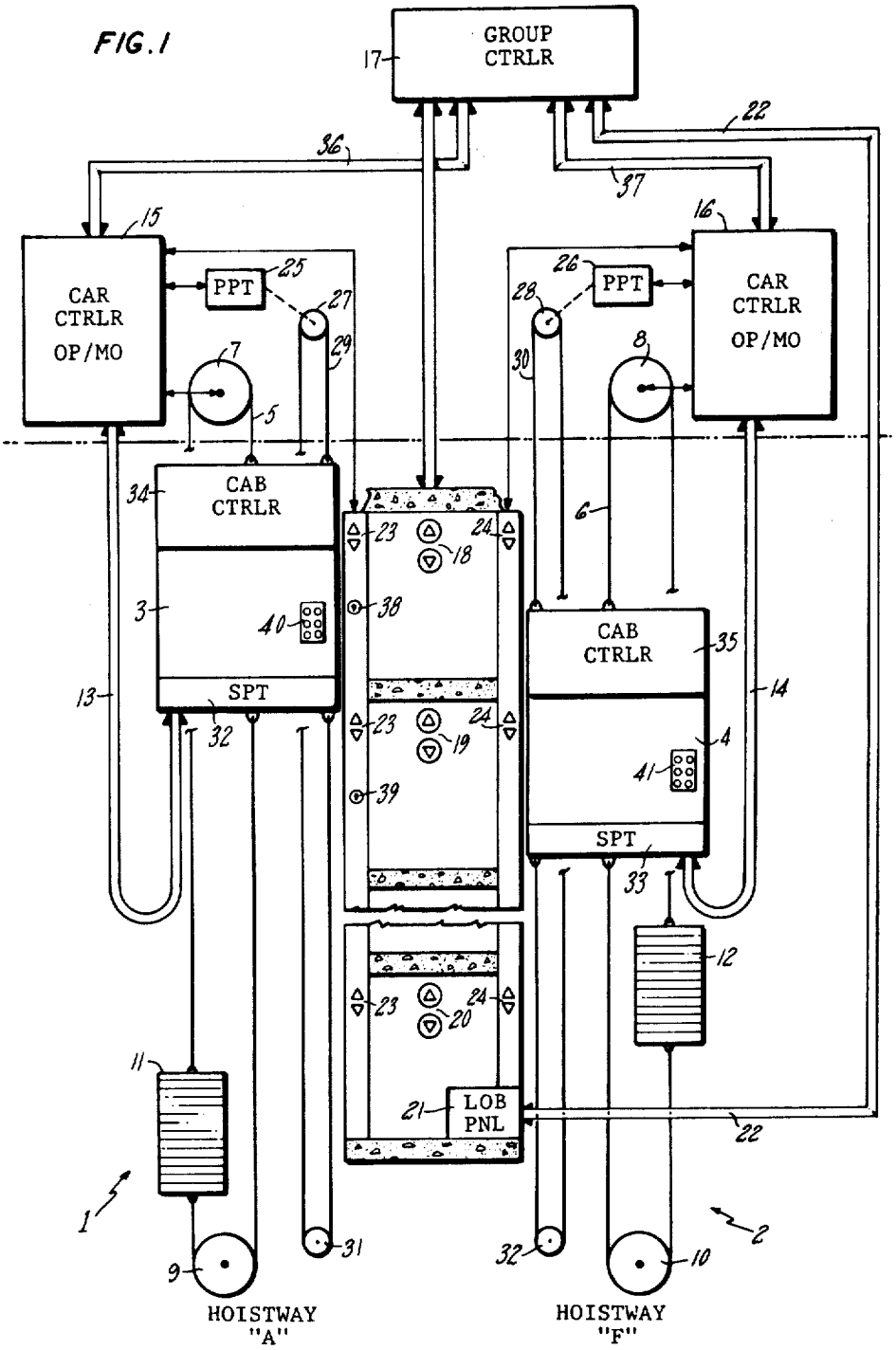
FIG. 1 is a simplified schematic block diagram of an elevator system in which the present invention may be implemented.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven in either direction or held in a fixed position by a drive sheave/motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissible load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18-20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975, now abandoned), entitled HIGH RESOLUTION AND WIDE RANGE SHAFT POSITION TRANSDUCER SYSTEMS now abandoned. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application filed on Nov. 13, 1979, by Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself may be directed, or communicated with, by means of a cab controller 34, 35 which may provide serial, time-multiplexed communications with the car controller as well as direct, hardwire communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977-1978 Second Edition, published by Digital Equipment Corporation, Maynard, Mass., U.S.A. And, Simpson, W. E., Luecke, G., Cannon, D. L., and Clemens, D. H., "9900 Family Systems Design and Data Book", 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Design News), Boston, Mass., U.S.A. And a useful work is Peatman, J. B., "Microcomputer-Based Design" published in 1977 by McGraw Hill Book Company (worldwide), U.S. Library of Contress Catalog No. 76-29345.

The software structures for implementing the present invention, and peripheral features which may be disclosed herein, may be organized in a wide variety of fashions. However, utilizing the Texas Instruments' 9900 family, and suitable interface modules for working therewith, an elevator control system of the type illustrated in FIG. 1, with separate controllers for the cabs, the cars, and the group, has been implemented utilizing real time interrupts, in which power-on causes a highest priority interrupt which provides system initialization (above and beyond initiation which may be required in any given function of one of the controllers). And, it has employed an executive program which responds the real time interrupts to perform internal program functions and which responds to communication-initiated interrupts from other controllers in order to process serial communications with the other controllers, through the communication register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 34, 35, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired. The controllers 15, 16, 17, may each be based on a microcomputer which may take any one of a number of well-known forms. For instance, they may be built up of selected integrated circuit chips offered by a variety of manufacturers in related series of integrated circuit chips, such as the Texas Instruments 9900 Family. Such a microcomputer may typically include a microprocessor (a central control and arithmetic and logic unit), such as a TMS 9900 with a TIM 9904 clock, random access memory, a read only memory, an interrupt priority and/or decode circuit, and control circuits, such as address/operation decodes and the like. The microcomputer is generally formed by assemblage of chips on a board, with suitable plated or other wiring so as to provide adequate address, data, and control busses, which interconnect the chips with a plurality of input/output (I/O) modules of a suitable variety. The nature of the I/O modules depends on the functions which they are to control. It also depends, in each case, on the types of interfacing circuitry which may be utilized outboard therefrom, in controlling or monitoring the elevator apparatus to which the I/O is connected. For instance, the I/Os which are connected to car call or hall call buttons and lamps and to switches and indicators may simply comprise buffered input and buffered output, multiplexer and demultiplexer, and voltage and/or power conversion and/or isolation so as to be able to sense cars hall or lobby panel button or switch closure and to drive lamps with a suitable power, whether the power is supplied by the I/O or externally.

An I/O module may provide serial communication over current loop lines 13, 14, 36, 37 between the car controllers 15, 16 and the cab controllers 34, 35 and the group controller 17. These communications include commands from the group controller to the cars such as higher and lower demand, stop commands, cancelling hall calls, preventing lobby dispatch, and other commands relating to features, such as express priority service when requested by a switch 38, 39. These communications also include information concerning car calls, normally requested by buttons in panels 40, 41 exchanged between cab and car controllers as well as the group controller. The group controller initiates communication with each of the car controllers in succession, and each communication operation includes receiving response from the car controllers, such as in the well known "handshake" fashion, including car status and operation information such as whether the car is in the group, is advancing up or down, its load status, its position, whether it is under a go command or is running, whether its door is fully opened or closed, and other conditions. And each car controller 15, 16 engages in similar communication with its own cab controller 34, 35. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends is unnecessary and not included herein.

Overall program structure of each controller, based upon a data processing system, in which the present invention may be practiced, is reached through a program entry point as a consequence of power up causing the highest priority interrupt, in a usual fashion. Then a start routine is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine in which all forcing (FORC) and all inhibit or cancel (INH) functions are cleared from memory; field adjustable variables are read and formatted as necessary; the status of each car is read and formatted as necessary; and all the hall calls and car calls are read, and corresponding button lights for sensed calls are lit. Then, all inputs obtained by communication between the cars, the cabs and the group are distributed to the various maps and other stored parameter locations relating thereto.

After initialization a variety of elevatoring functions are performed by various routines on various time bases. Such routines include assigning cars to answer hall calls, parking cars in zones, handling up peak and down peak traffic, and various other functions, including the emergency priority service described hereinafter with respect to the present invention. The car controllers 15, 16 may be implemented in a fashion similar to that described hereinbefore with respect to the group controller 17, having I/O devices suitable for communication with the cab controllers 33, 34 over lines 13, 14 and suitable for interacting with circuitry for controlling the sheave/motor/brake assemblies 7, 8 as well as any related transducers, such as the primary position transducers 25, 26. The car controller has a principal task of controlling the motion of the cab, and at times controlling the cab door. These functions necessarily include other, known subfunctions such as recognizing car calls, and responding to car calls or floor calls assigned by the group (or otherwise) in conjunction with the position of the cab to cause the cab to open and close its doors at appropriate times. Since these functions, and the communications between the various controllers to effect them, are, except as provided hereinafter with respect to the present invention, generally known and within the skill of the art, no particular aspect of them being involved herein except as provided hereinafter, further discussion thereof is not otherwise provided herein.

Figure 2:
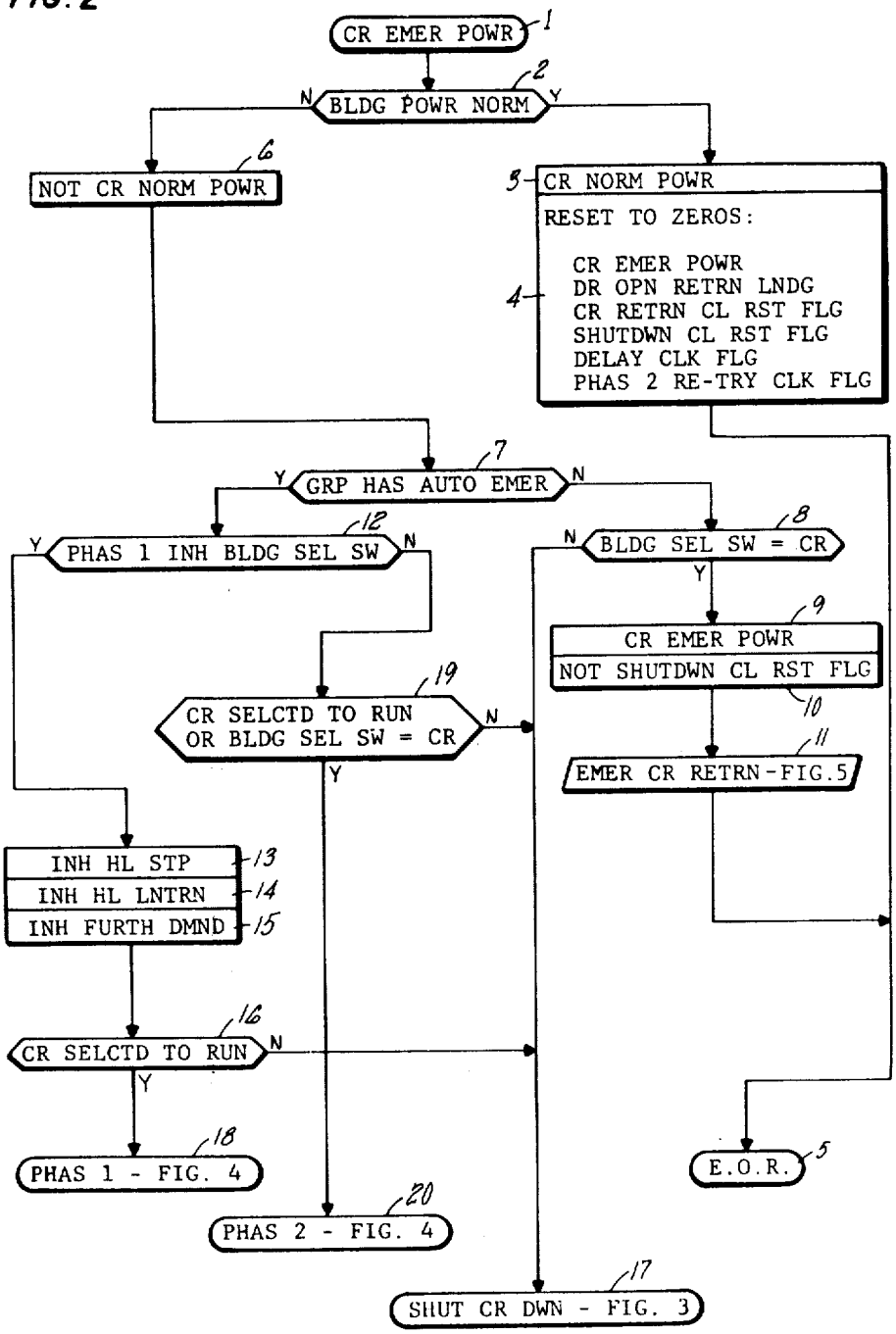
FIGS. 2–4 comprise a logic flow diagram of a car emergency power routine which may be performed in the car controllers of FIG. 1, in accordance with the present invention.

A car emergency power routine which is run in the microprocessor of each car controller 15, 16 (FIG. 1) is reached through an entry point 1 in FIG. 2 and a first test 2 directly interrogates the status of the building main power line feeders to determine if the building has normal power. If it does, an affirmative result of test 2 leads to a step 3 which sets (or reinforces) a status bit indicating that the car is running on normal power, and a plurality of steps 4 in which the car emergency power status flag is set to the zero (not true) state, a status flag indicating that the car door is open at the return landing is set to zero, a pair of once-only flags utilized to control resetting of car calls during a car return operation and during shutdown of a car are reset to zero, a once-only delay clock flag and a once-only phase two re-try clock flag are set to zero. Then, other parts of the program of the microprocessor within the car controller 15, 16 (FIG. 1) are reverted to through an end of routine point 5.

Figure 5:
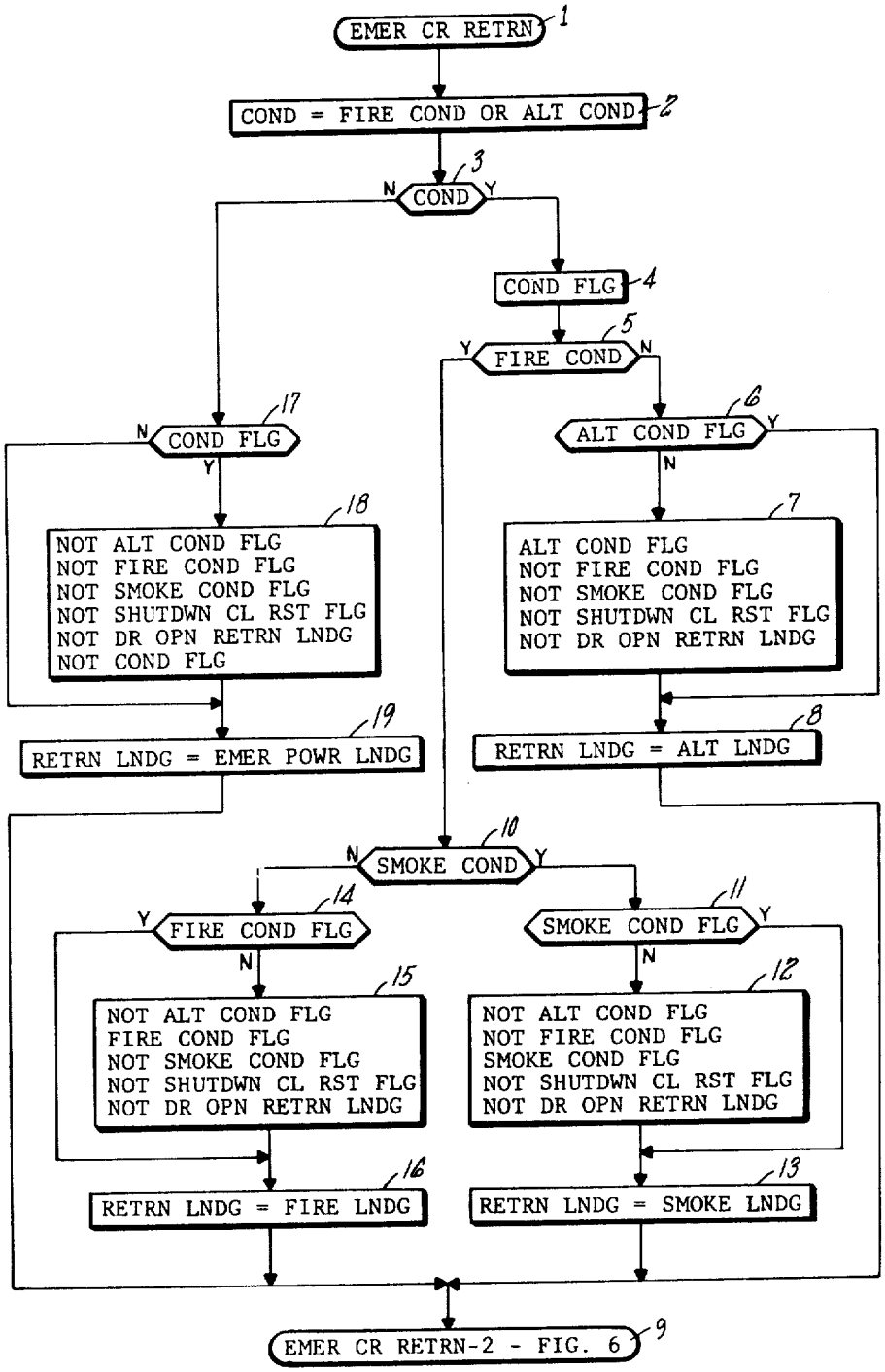
FIG. 5 and 6 comprise a logic flow diagram of an emergency car return subroutine which may be utilized within the routine of FIGS. 2–4.

In FIG. 2, in the absence of normal building power, a negative result of test 2 will reach a step 6 which resets the car normal power status flag. When the car does not have either a normal power status or an emergency power status, the car becomes immobile and cannot run. However, a car will not have emergency power status except when it is selected to run on emergency power, in a manner described hereinafter. A test 7 determines if the particular elevator installation has automatic group control during emergency power, or not. This is an option of the building in which the elevator system is installed, and if the elevator system does not have the option in place, a negative result of test 7 will reach a test 8 to determine if a building car selection switch (typically in the lobby panel 21, FIG. 1) is set to select the particular car in question, vs. all the other cars in group. If the building select switch is set to select this particular car, an affirmative result of test 8 will reach a step 9 which sets the car emergency power status bit that renders the car capable of operation, and a step 10 which resets the shutdown call reset flag (in the event that the car had previously been shut down and the flag may have been set in a manner described with respect to FIG. 3 hereinafter). Then an emergency car return routine 11, described hereinafter with respect to FIG. 5, is performed in order to cause the car to be recovered or returned to a designated emergency landing. And then the routine ends through point 5.

In FIG. 2, an affirmative result of test 7, indicating that the group controller will automatically perform the selection of cars for operation on emergency power, causes a test 12 to determine if the group has completed a phase one portion (within which the group attempts to cause all cars to return to an emergency landing): during the first phase of automatic group control, the building select switch is not allowed to designate cars since that would interfere with the group control automatic selection of cars which is about to be described. During the first phase, an affirmative result of test 12 will reach steps 13-15 in which hall stops, hall lantern and further demand functions of the car controller (15, 16, FIG. 1) are inhibited. This prevents the car from responding to any previously instituted group control, so that the car will respond only to either the phase one group control (described with respect to FIG. 4 hereinafter) or to the car shutdown procedure described with respect to FIG. 3 hereinafter, alternatively, in dependence upon whether a test 14 determines that the car is selected to run or not, respectively. If the group has not selected this car to run, a negative result of test 16 will cause a shut car down portion of the routine to be reached through a transfer point 17. But if the car is selected to run, a phase one portion of the routine will be reached through a transfer point 18.

In FIG. 2, if phase one has been completed (in a manner described elsewhere herein), then a particular car may be selected by the group if the building select switch is set to automatic, giving the group controller (17, FIG. 1) the option of selecting the cars; otherwise, the building select switch can be set to select a particular car. Thus a negative result of step 12 (indicating phase two operation in which switch selection of the car is permitted) will reach a test 19 to determine whether the car is selected by either the group controller or the building select switch. If the car is selected, an affirmative result of test 19 will reach a phase two portion of the routine through a transfer point 20; but if the car is not selected, a negative result of test 19 will reach the shut car down portion through the transfer point 17.

The functions of FIG. 2 are therefore to determine whether or not the car is operating on normal power and whether or not the group controller (17, FIG. 1) is provided with the automatic emergency power option described with respect to FIGS. 7-10 hereinafter: and if not, to allow one elevator determined by the building select switch to be operated, the remainder to be shut down, or if so, to determine whether a first phase of automatic control or a second phase is involved, and to allow one or more cars at a time to operate under automatic control.

Figure 3:
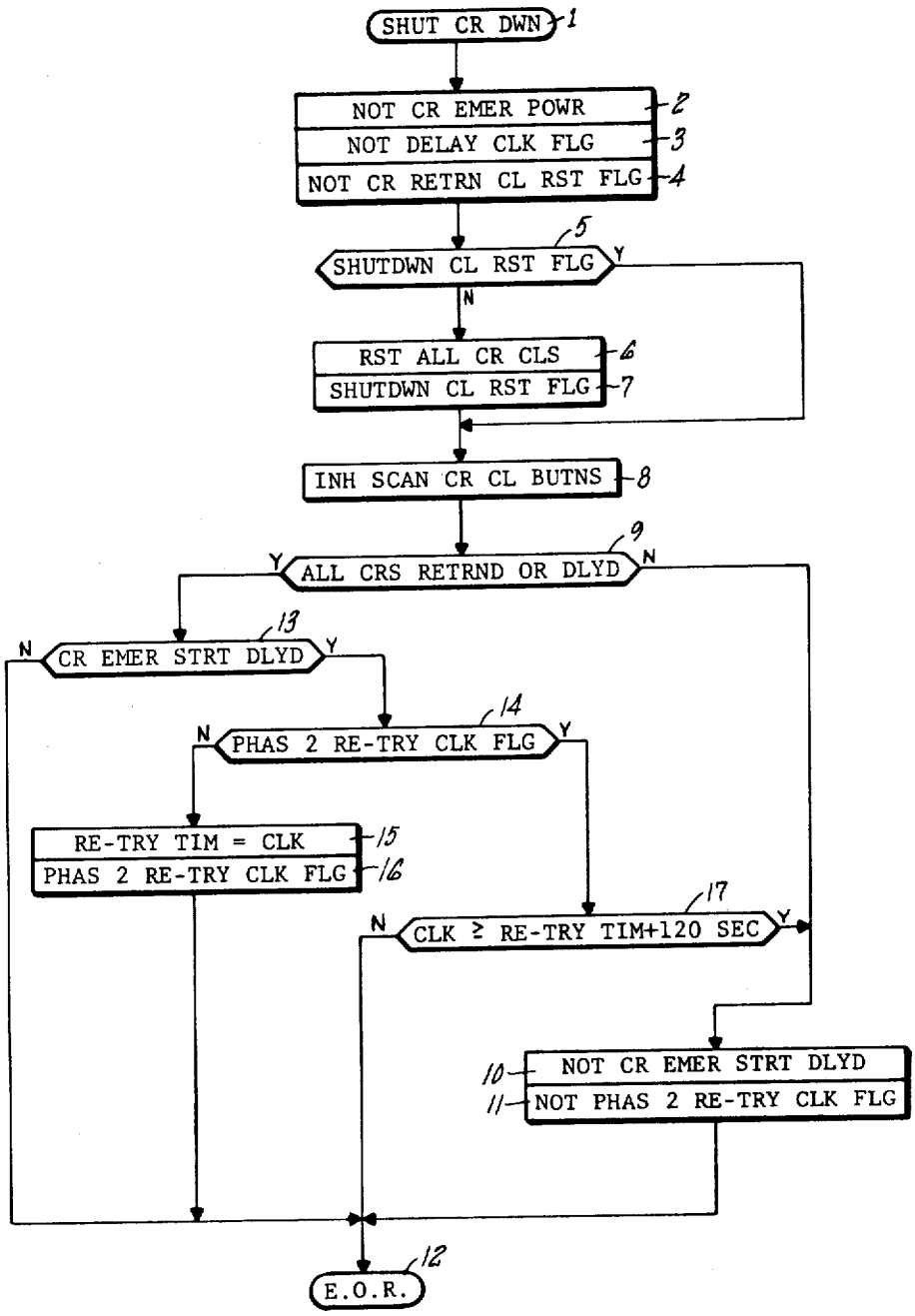

In FIG. 3, the shut car down portion of the routine is reached through an entry point 1, and a plurality of steps 2-4 cause the car emergency power status, the delay clock flag, and the car return call reset flag to all be reset to zero (not true state). Then a test 5 determines if the shutdown call reset flag has been set, and if not, a command is given to reset all car calls in a step 6 and the shutdown call reset flag is set in a step 7. Once the shutdown call reset flag has been set, subsequent passes through FIG. 3 (prior to either return to normal operation or selection of this car to run) will cause the steps 6, 7 to be bypassed. Then, a step 8 issues a command to inhibit scanning of car call buttons so that no new car calls can be registered in the car.

In FIG. 3, a test 9 determines if the group controller has set a status flag indicating that all cars have either been returned to an emergency return landing or have been determined to be unable to return (that is, delayed). In a case where an elevator system does not have the automatic group control option in it, this status flag will necessarily always be absent, causing a negative result of test 9. This reaches a pair of steps 10, 11 in which a status bit (indicating that the car involved has had its emergency start delayed) and the once-only re-try clock flag are both reset to zero. And the program reverts to other matters through an end of return point 12. Thus, in a system without automatic control, or in a system with automatic control which is still operating in the first phase of automatic emergency power control, a car is always indicated as not being a delayed car to permit the car to be selected during a recycling of phase one recovery procedures, described with respect to FIG. 9, hereinafter. And, the re-try clock flag is reset so that re-try may occur in phase two operation, as described hereinafter with respect to FIG. 10.

In a case where automatic group emergency power control is provided, once all of the cars have been given the opportunity to return to an emergency floor landing (recovered), even though some of the cars might not have responded and may not have returned to a designated landing, phase two operation takes place and an affirmative result of test 9 in FIG. 3 will reach a test 13 which interrogates a status bit indicating whether or not this particular car was delayed in its attempt to start on emergency power. If this car did not have an excessive delay in starting on emergency power, when selected to do so, a negative result of step 13 causes the program to revert to other matters through the end of return point 12. But if this car was unable to start in a reasonable time (such as 35 seconds, as described hereinafter), then it will have set its car emergency start delayed status bit so that an affirmative result of test 13 will reach a test 14 to see if the once-only phase two re-try clock flag has been set or not. If not, a re-try timer is started so as to allow trying once again to recover this particular car every 2 minutes (or other suitable time interval). Thus a negative result of test 14 causes a step 15 to set re-try time equal to real time (clock), and a step 16 sets the phase two re-try clock flag (so that step 15 will not be reached in subsequent passes through the routine portion of FIG. 3). In subsequent passes through FIG. 3, during phase two operation, so long as this car is not selected to run, an affirmative result of test 14 will reach a test 17 which determines whether or not 120 seconds have elapsed since starting of the re-try clock. If not, the routine is simply ended. But an affirmative result of test 17 will reach the steps 10, 11 so as to cause the delayed status of the car to be removed, thereby making this car eligible for an attempt at movement, and the re-try clock flag is reset. The removal of this car's delayed status is necessary, as described with respect to the group phase two subroutine described with respect to FIG. 10 hereinafter, to allow selection of this car for running on emergency power in an attempt to recover it. This is one aspect of the present invention: continuously re-trying, on a periodic basis, to recover cars which initially are not responsive to a command to return to a designated landing when on emergency power.

Figure 4:
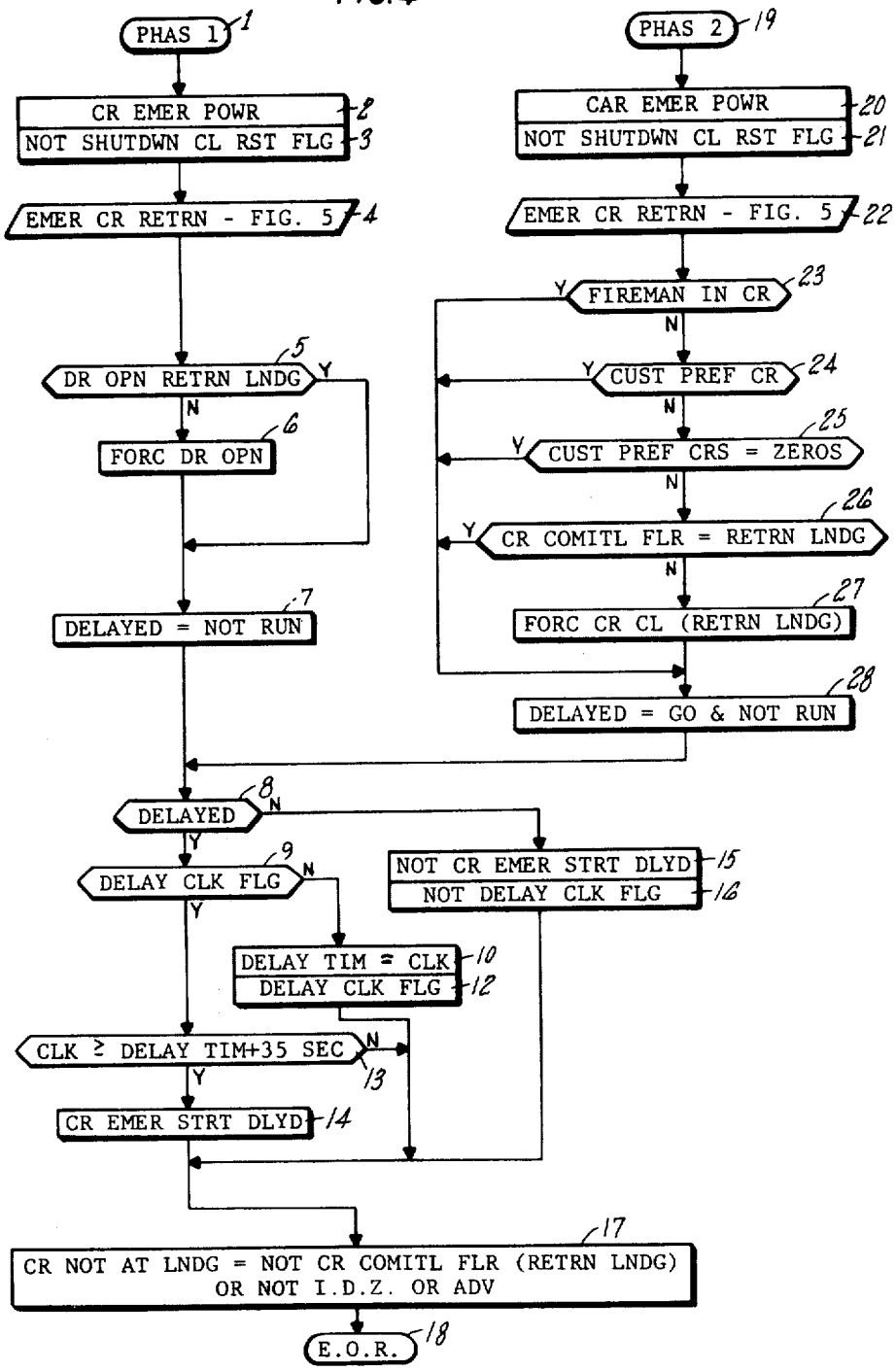

So long as a car is not selected to run on emergency power, in each cycle of its microprocessor program within its car controller (15, 16, FIG. 1), the routine will proceed through FIG. 2 through the transfer point 17 and through FIG. 3. But, as a consequence of the building select switch being set to indicate selection of this particular car or the group controller selecting this particular car to run on emergency power, this car's routine will proceed down through FIG. 2 initially to the transfer point 18 (during phase one operation), or through the steps 9 and 10 in the case where there is no automatic group control, as described hereinbefore. In the normal case, where the invention is fully utilized, a selected car will have its program advanced through the transfer point 18 to the phase one portion of the car emergency power routine, which is reached through an entry point 1 in FIG. 4. In FIG. 4, once the car is selected to run, its car emergency power status is established by a step 2 and a step 3 resets the once-only shutdown call reset flag (which will normally have been set because, in a normal case, a car will initially not be selected and thereafter become selected). Then the emergency car return subroutine described with respect to FIG. 5 hereinafter is reached at stage 4 of FIG. 4, so as to cause the car to be recovered to a return landing, if at all possible. Until the car does reach the return landing and open its doors, a test 5 interrogates the status of this car having opened its door at a return landing and the negative result will cause a force door open command, in a step 6, that continuously tries to force the door open. Naturally, the door of an elevator will not open until it is proper to do so, so the forcing function will have no effect until the car is located suitably at a landing. Then a delayed status is set equal to the complement of the run status of the car in a step 7. If, when commanded to run in response to a forced car call (described with respect to FIG. 5 hereinafter) the car does not in fact run, after a suitable period of time, then it is known that the car is delayed. If the car does not run, then a test 8 will have an affirmative result which will reach a test 9 to determine if the delay clock flag has been set yet, or not. If not, a negative result of test 9 will cause a step 10 to initiate the delay timer by setting delay time equal to the real time clock; and, a step 12 will set the delay clock flag so that step 10 will not be reached in subsequent passes through the routine. In subsequent passes, an affirmative result of test 9 will cause a test 13 to interrogate the status of the delay timer to see if 35 seconds have expired since the delay timer was initiated. If not, nothing happens; but after 35 seconds of delay (which is plenty of time to get an elevator running once it is commanded to do so), an affirmative result of test 13 will cause a step 14 to set a status bit indicating that this elevator car emergency start is delayed (this is the status bit which is automatically reset in step 10 of FIG. 3, as described hereinbefore). In FIG. 4, in case the car ultimately does respond within 35 seconds, a negative result of test 8 will occur so that the car emergency start delayed indication will be reset (if it had previously been set) and the once-only delay clock flag is reset in a pair of steps 15, 16. In any event, whether or not the car has reached the landing is determined in a step 17, in which the car not at landing status is determined to be true is the car does not have a committable floor position equal to the return landing (the return landing being one selected as described with respect to FIG. 5 hereinafter), or even if it is committed to that floor, if it is not within the inner door zone, or if it has advance status, which is the case whenever it is running without commitment to stop at the next floor. Thus a car is determined to not be at the landing if it is not near it, or if it is not close enough to it to open the doors (inner door zone), or, even if it is within the inner door zone at the desired landing, if it has been commanded to leave that landing and therefore will not remain there. Then, other parts of the program are reverted to through an end of routine transfer point 18.

Referring again to FIG. 2, once all cars have had a chance to return to a landing, the automatic group controller will switch from phase one to phase two which is manifested in FIG. 2 by a negative result of test 12. A negative result of test 12 therefore indicates phase two operation and test 19 determines whether the car is selected or not. If not, the transfer point 17 will cause the car to be shut down (or continue to be reinforcing shutdown). But if the car is selected to run, whether by the building select switch or by the automatic selection process in the group controller (17, FIG. 1), as described with respect to FIGS. 7–10 hereinafter, an affirmative result of test 19 will cause the program to advance through the transfer point 20 to an entry point 19 of the phase two portion of the car emergency power routine in FIG. 4. In the phase two portion, the car can be running either because it is being utilized as a car to provide service during emergency power conditions, or it could be running because it was a delayed car and the re-try timer has timed out (17, FIG. 3) and another attempt is being made to recover the car to the designated landing.

In FIG. 4, the phase two portion, reached through the entry point 19, commences with a step 20 to set the car emergency power status so that the car can run, and the shutdown call reset flag is reset in step 21. Then the emergency car return routine, described with respect to FIG. 5 hereinafter, is reached at point 22 of FIG. 4, and a series of tests 23-26 determine whether the car should continue to run or whether the car should be forced to the return landing to allow other cars to run in its place. If the car status is firemen service, and the fireman has entered the car and taken over control of the car with a key switch, then the car is allowed to continue to run, since code requirements include absolute priority to firemen. Thus an affirmative result of test 23 will allow the car to continue to run during phase two. In the case where this car is a car designated as preferred for operation on emergency power (eg, because it has access to more landings or a rear door), a test 24 will be affirmative and the car is allowed to continue to run. But even if this car is not preferred, if there are no other preferred cars (as described hereinafter with respect to FIG. 10), then a map of preferred cars in storage will be all zeros and a test 25 will be affirmative allowing the present car to continue to run. If the particular car has the return landing as its committable floor, it is allowed to continue to reach that landing without any interference by an affirmative result of test 26. On the other hand, if the results of all of the tests 23-26 indicate that this car is not being run by a fireman, it is not a preferred car but there are other preferred cars to which this car should yield for service on emergency power, and this car is not directly headed to the return landing, then this car is forced to the return landing, so that it can possibly be taken off service to allow other cars to be run, by a step 27 which forces a car call to the return landing.

In FIG. 4, whether or not the car is allowed to continue to run during phase two, a delayed status bit is set in a step 28 to equal the car's go status ANDed with the complement of its run status. Thus, if the car has a go command for a long period of time without running, it is delayed. But, mere failure to run during phase two may only be indicative of no request for service (whereas in phase one, the car is commanded to return to the landing). This status is tested in test 8, and operation proceeds as described with respect to tests and steps 8 through 17, hereinbefore. Notice that a car could have previously been recovered to the emergency landing, and could have been put into emergency operation so as to provide service to passengers and thereafter become delayed. In such case, the recovery process will be repeated during the continuance of phase two operation, in the same fashion as for a car which initially was unresponsive during phase one (and subsequently phase two) recovery procedures.

Referring to FIG. 5, the emergency car return subroutine is reached through an entry point 1, and a first step 2 sets a condition status bit if a fire condition status bit or an alternative condition status bit has been set. The fire condition status bit is set in response to a switch or an alarm whenever there is fire in the building; the alternative condition status bit is set (such as by a switch on the lobby panel 21, FIG. 1) in the case of a riot or other special condition concerning which it is decided that special elevator service should be provided. In the portion of the emergency car return subroutine illustrated in FIG. 5, the only function is to determine whether the emergency power situation is coupled to a fire, fire with smoke at the normal fire return landing, or some alternative condition (such as a riot), and to select an appropriate return landing. For instance, during normal emergency power failure (unrelated to the conditions in the building), the main lobby may be the selected return landing to which all cars are initially returned. On the other hand, during a fire, the fire code may require passengers be returned to a first basement. Thus, the first basement would be established as the fire landing to be used for the return landing. But if there were smoke detected in the first basement, then either the main lobby or a second basement may be used as a fire landing. And the alternative landing may be a first landing above the lobby (allowing people to avoid conditions in the lobby by using staircases and back entrances, and the like). All of this may be established for each building depending upon the landings selected as the normal emergency power landing, the fire landing, the smoke landing, or the alternative landing.

In FIG. 5, if there is a special condition (fire or riot), a test 3 will be affirmative causing a step 4 to set a condition flag (used as described hereinafter). Then a test 5 determines if the condition is the fire condition or not. If not, a negative result of test 5 will cause a test 6 to determine if a once-only alternative condition flag has been set or not. In the initial pass through FIG. 5, the flags will never have been set, and therefore the first pass through test 6 will be negative. This causes a series of steps 7 to set the alternative condition flag, to reset the fire, smoke and shutdown call reset flags, and to reset the door open at return landing status bit. Then a step 8 establishes the return landing as whatever landing is stored as the desired alternative landing, and the second portion of the emergency car return subroutine is reached through a transfer point 9.

In FIG. 5, if there is a fire, test 5 will be affirmative causing a test 10 to check for smoke detected at the fire landing. If there is, than a test 11 determines if the smoke condition flag has been set or not, which initially will be not. This causes a series of steps 12 to reset the alternative condition flag, the fire condition flag and the shutdown call reset flag, to set the smoke condition flag (so that test 11 will be affirmative in subsequent passes through FIG. 5) and to reset the door open at return landing status bit. Then a step 13 causes the return landing to be established as the designated smoke landing (the landing to be used during a fire when smoke is detected at the normal fire landing), and the second portion of the subroutine is reached through point 9.

In FIG. 5, if test 10 is negative, a test 14 determines if the fire condition flag is set. Normally test 14 is initially negative so that a series of steps 15 will reset the alternative condition flag, the smoke condition flag and the shutdown call reset flag, as well as setting the fire condition flag and resetting the door open at return landing status bit. In step 16, the return landing is established as the fire landing and the second portion of the subroutine is reached through transfer point 9.

In FIG. 5, if neither a fire nor a riot (or other alternate condition) is present, test 3 will be negative causing a test 17 to determine if the condition flag (step 4) had been set or not. This could occur when there has been a riot or a fire, but the normal power may not be restored. If there is a change from fire or alternate condition to ordinary emergency power conditions, test 17 will initially be affirmative; but if the emergency power routine is being run simply as a result of loss of normal power not concerning other matters in the building, test 17 would be negative. If test 17 is affirmative, a series of steps 18 will reset the alternative condition flag, the fire condition flag, the smoke condition flag and the shutdown call reset flag along with the door open at return landing status bit, and will reset the condition flag as well. Then a step 19 will establish the return landing as the emergency power landing and the second portion of the emergency car return subroutine will be reached through the transfer point 9. Notice that conditions could change. Initially, there may be a riot; as a consequence, a fire may break out. But then smoke may appear at the normal fire landing, so that the landings could be changed from alternative, to fire, to smoke, in sequence. Therefore, the subroutine portion of FIG. 5 is run during each machine cycle, and any change in condition resets the door open at return landing status bit, to ensure that any car to be recovered will be recovered to a currently-correct landing.

Figure 6:
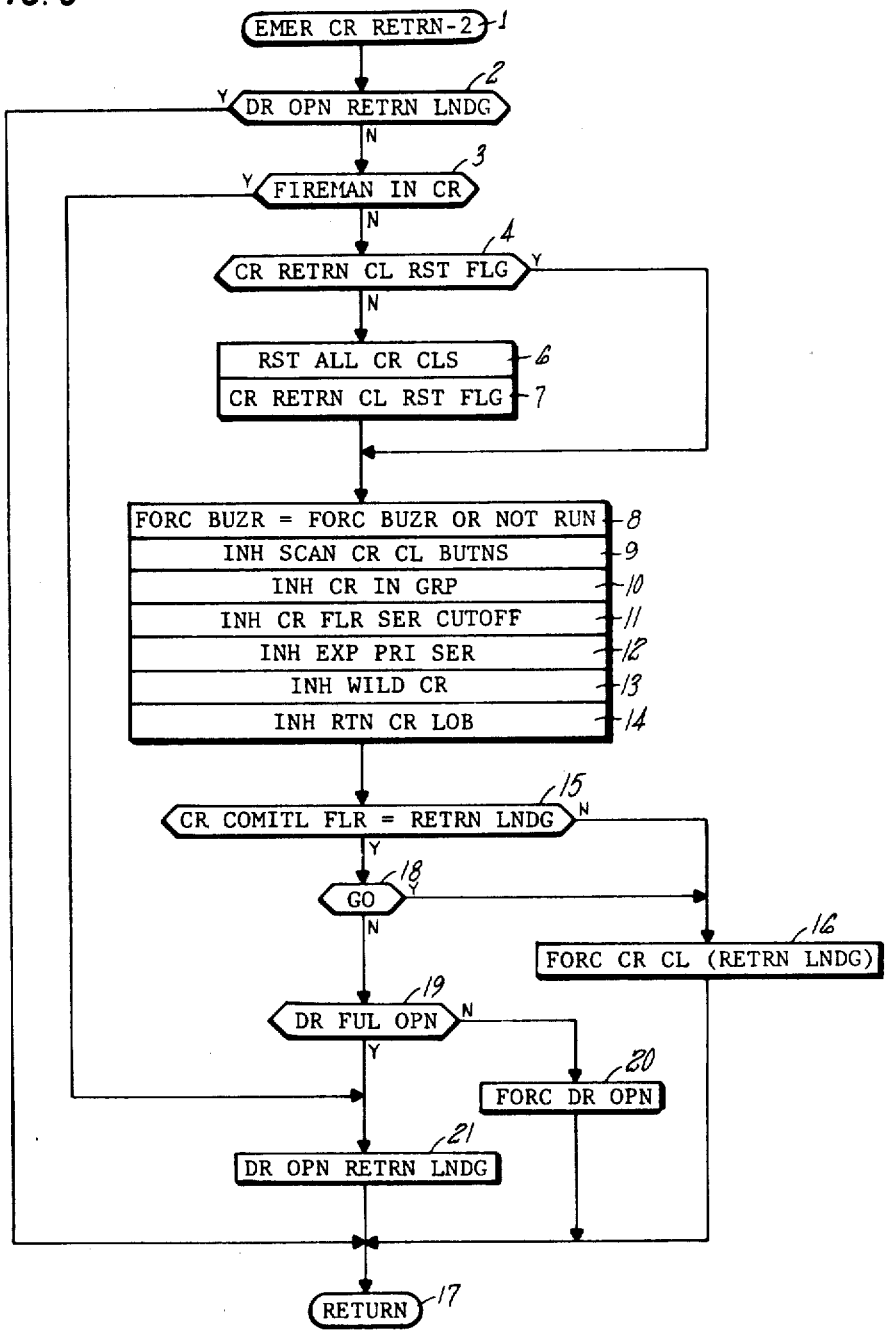

Once the correct landing has been established, the second portion of the emergency car return subroutine is reached in FIG. 6 through an entry point 1. A test 2 determines if this car's door is open and the car is at the return landing, in a manner described hereinafter. This is a status bit which is reset to zero during power on reset so that once it is set for any car it remains set thereafter. However, as is described with respect to FIG. 5, if the conditions (fire, smoke, riot) change, the door open at return landing status for the car is reset, so that it must immediately return to the newly-designated landing to suit present conditions, whether it is a delayed car or an operating car. Thus, when a car is initially recovered to the emergency landing, the door open at return landing status bit is set. If the car is thereafter pressed into normal service during emergency power conditions, the status bit remains set indicating that this is a car which does not need to be recovered, but is simply a car that is in use for service during emergency power. In the normal case, initially test 2 will be negative because the car must first be recovered before it can be pressed into service. This will cause a test 3 to determine if the fireman is in the car (that is, whether the car is on fireman status and a fireman has entered the car and operated a key for independent fireman service). If not, a negative result of test 3 will reach a test 4 to determine if the car return call reset flag is set yet. Normally, an initial pass through FIG. 6 will find the car reset flag not set, so a negative result of test 4 will reach a step 6 which commands that all car calls be reset, and then a step 7 will set the car return call reset flag, so that the command to reset car calls (step 6) will not be reached in subsequent passes through FIG. 6.

In the case of a car which is trying to be initially recovered to the return landing (or caused to be recovered to a new return landing following a change in conditions as described with respect to FIG. 5), tests 2 and 3 will be negative and ultimately a series of steps 8–14 are reached. In step 8, the force buzzer command is set equal to the force buzzer command or the not run condition of the car. This allows the buzzer to be forced for other purposes (such as if communications are lost between the cab controller and the car controller, and the doors are opened at a landing) or, when the car has reached the return landing under the routine of FIG. 6, in order to urge the passengers to leave the car.

Then the steps 9–14 inhibit various operational modes of the car controller (15, 16, FIG. 1) so that the car will only respond to a car call as described hereinafter. The functions inhibited include the scanning of car call buttons, the car being in the group, car floor service cutoff (because the alternative landing, for instance, may be one to which this car normally is not permitted), express priority service (to avoid an operator from commandeering the car), wild car service (in the event that the group controller fails) and automatic returning of the car to the lobby for other purposes (since the lobby may not be the return landing). Then, a test 15 determines if the car committable floor (the next floor at which it could possibly stop) is equal to the return landing selected as described with respect to FIG. 5. If not, a step 16 forces a car call to the return landing and the subroutine is ended and the appropriate part of the car emergency power routine (transfer point 5 in FIG. 2, test 5 in FIG. 4 or test 23 in FIG. 4) is reverted to through a return point 17. Assuming the car does respond and advance toward the return landing, eventually test 15 will be affirmative. Then a test 18 will determine if the car still has go status; as long as it does, test 16 continues in each cycle to force a car call to the return landing. Eventually, the car will be close enough to the return landing so that the go status will be lost, and a negative result of test 18 will reach a test 19 to determine if the car door is fully open. If it is not, a step 20 issues a force door open command. But if the door is fully open, an affirmative result of test 19 causes a step 21 to set the door open at return landing status for this particular car. And then the correct part of the car emergency power routine is reverted to through the return point 17.

The car functions described with respect to FIGS. 2–6 hereinbefore relate only to emergency power service, and only to recovery of the cars. If the elevator system has group control over automatic emergency service, phase one, governing return of each car once to the selected landing (depending upon the particular condition) is controlled by the group. Thereafter, during phase two, either the group may select cars to run or the building select switch may select cars to run. If there is no group automatic emergency service control in the elevator system being considered, only the building select switch can cause cars to be recovered and to provide service thereafter.

Figure 7:
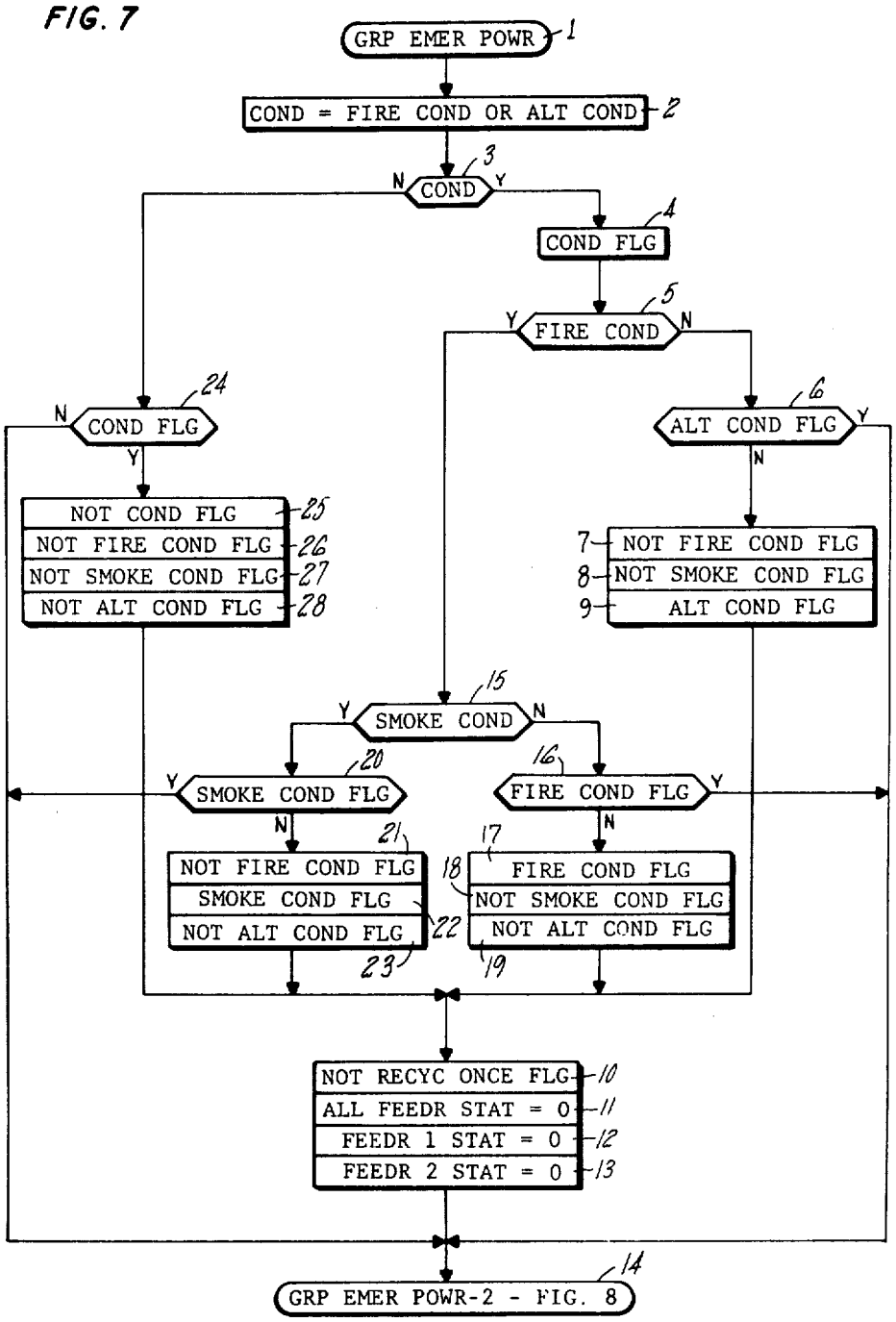
FIGS. 7–10 comprise a logic flow diagram of a group emergency power routine which may be run within the group controller of FIG. 1, in accordance with the present invention.

The functioning of the group controller 17 (FIG. 1) is governed by its microprocessor in response to a group emergency power routine illustrated in FIGS. 7–10. In FIG. 7, the group emergency power routine is reached through an entry point 1 and a first step 2 sets a condition status equal to fire condition or the alternative condition (in a manner analogous to that described with respect to FIG. 5 hereinbefore). If a fire condition or alternative condition exists, a test 3 will be affirmative so that a step 4 will set a condition flag. Then a test 5 determines if the fire condition is present, and if not, a test 6 will determine if an alternative condition flag has been set or not. It should be borne in mind that the conditions of FIG. 7 are the same as those in FIG. 5, but the flags of FIG. 7 are flags within the microprocessor of the group controller 17 (FIG. 1), whereas the flags of FIG. 5 are those within the related car controllers 15, 16 (FIG. 1).

In FIG. 7, initially the alternative condition flag will not be set so that a negative result of test 6 will reach steps 7–9 in which the smoke and fire condition flags are reset and the alternative condition flag is set. Then a recycle once flag is reset in a step 10 and the all feeder status, feeder 1 status and feeder 2 status are each set to zero in steps 11–13. After that, a second part of the group emergency power routine is reached through a transfer point 14.

In FIG. 7, if test 5 is affirmative indicating that there is a fire, a test 15 will determine whether the smoke alarm has indicated smoke at the fire landing. If not, a step 16 will examine whether or not the fire condition flag has been set yet: if not, a series of steps 17–19 will set the fire condition flag and reset the smoke condition flag and the alternative condition flag. Then the steps 10–13 will be performed.

If test 15 of FIG. 7 is affirmative, a test 20 will determine if the smoke condition flag has been set. If not, a series of steps 21–23 will reset the fire and alternative condition flags, and set the smoke condition flag. Then the steps 10–13 will be performed.

In FIG. 7, if test 3 is negative, indicating there is not a fire or a riot or the like, then a test 24 will determine whether there previously had been a fire or alternative condition. In a normal case, loss of normal power will occur because of conditions outside of the building, so that the condition flag will not have been set in step 4 and therefore tests 3 and 24 will normally be negative. Therefore, during a normal loss of power, the subroutine of FIG. 7 performs no function at all. But if the condition flag had been set, an affirmative result of test 24 will lead to steps 25–28 which reset the condition flag, the fire condition flag, the smoke condition flag and the alternative condition flag, and then cause the steps 10–13 to be performed. In any case, following one pass through FIG. 7, during which the flags are tested and set or reset for any given condition, and the steps 10–13 are performed, in any subsequent pass through FIG. 7, unless the conditions change, the only function performed in FIG. 7 is to interrogate the appropriate condition flags and reach the transfer point 14.

Figure 8:
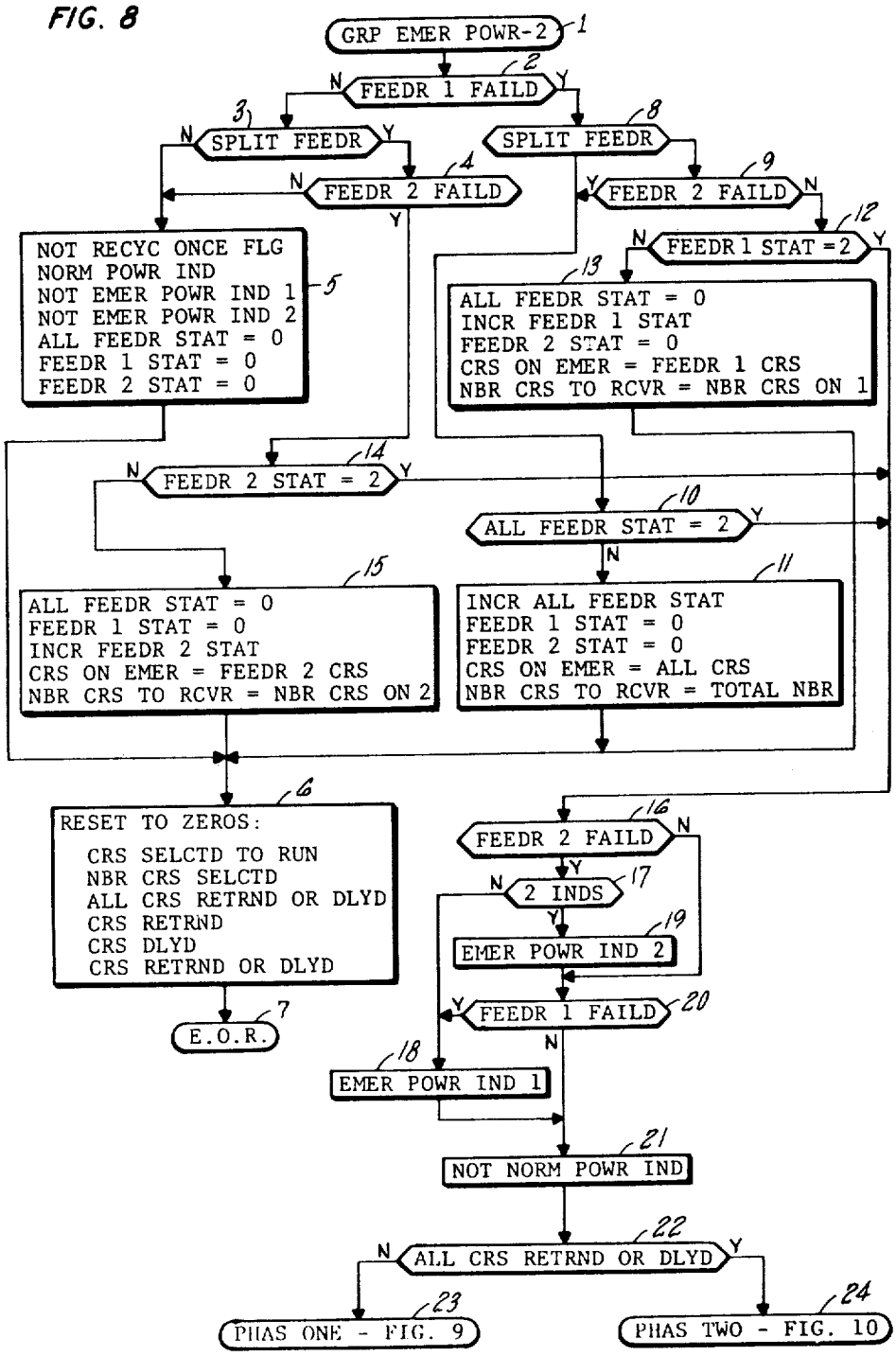

In FIG. 8, a portion of the group emergency power routine determines whether there are one or two feeders (independent power lines) supplying power to the individual elevators within a particular group. Depending on whether there is more than one feeder and whether both feeders have failed, conditions are established to operate all the cars on the emergency power basis, or to operate only those cars on the failed one of two feeders to operate under emergency conditions. The portion of the group emergency power routine of FIG. 8 is reached through an entry point 1 and a first test 2 determines if feeder 1 has failed. In the normal case, the group will not be on emergency power, and none of the feeders will have failed. Thus test 2 will normally be negative reaching a test 3 which determines whether more than one feeder is used to power the group. If so, a test 4 will determine if the second feeder has failed. In the normal case, there will be no feeder failure so that either test 3 or test 4 will be negative causing a series of steps 5 to be performed. This resets a number of the group emergency power routine status indicators including a recycle once flag, emergency power indicators 1 and 2, and the statuses of all feeders, feeder 1 or feeder 2, the significance of which is described hereinafter. Also, among the steps 5, a normal power indicator is set. Then a series of steps 6 are reached to reset to zeros a variety of status indicators and maps (maps being words having one bit per car which have the status designated by the word): the map of cars selected to run, a word indicating the number of cars which have been selected to run, a status bit indicating that all cars have been subject to attempted recovery and have been returned or determined to be delayed, a map of cars which have been returned, a map of cars determined to be delayed, and a map of cars determined to be returned or delayed. Then, other parts of the program of the microprocessor within the group controller 17 (FIG. 1) are reached through an end of routine point 7.

In FIG. 8, if test 2 indicates that feeder 1 has failed, a test 8 determines if there is more than one feeder. If so, a test 9 determines if the second feeder has also failed. If test 8 is negative or test 9 is affirmative, a test 10 will check an all feeder status to see if the status is 2. In the first instance, since the feeder status has been reset to zero in a normal case (step 5 of FIG. 8), test 10 will be negative reaching a plurality of steps 11 in which the all feeder status is incremented by one, the feeder 1 status and feeder 2 status are both set to zero, a map of cars on emergency power is set equal to all the cars in the group, and a word bearing a number equal to the number of cars which must be recovered is set to the total number of cars in the group. Then the steps 6 are performed and the routine is ended through point 7.

Assuming that both feeders failed together, or there is only one feeder and it has failed, the second pass through FIG. 8 will again reach test 10 which again will be negative, so that in steps 11 the all feeder status will be advanced from 1 to 2. And in the third pass through FIG. 8, the test 10 will be affirmative causing the program to advance in a different way which is described hereinafter.

In a similar fashion, if feeder 1 has failed but test 8 is affirmative and test 9 is negative indicating that only feeder 1 has failed, then a negative result of test 9 will reach a test 12 to interrogate the status of feeder 1. Initially, test 12 will be negative because the status normally starts out at zero. Then a series of steps 13 will cause the all feeder status to be set at zero, will cause the feeder 1 status to increment from zero to 1, will cause the feeder 2 status to be zero, will set the map of cars on emergency power equal to those cars which are being powered by feeder 1, and will set the number of cars to be recovered to be equal to the number of cars which are fed by feeder 1. Then the steps 6 will be performed. In the second pass through FIG. 8 with only feeder 1 failed in a split feeder, test 12 will again be negative and within the steps 13 the feeder 1 status is incremented from one to two. In the third pass through FIG. 8, test 12 will be affirmative causing the program to advance in the manner to be described hereinafter.

If in FIG. 8 test 2 determines that feeder 1 has not failed and test 3 determines that there is a split feeder, and test 4 determines that feeder 2 has failed alone, then a test 14 will determine the status of feeder 2. In a series of steps 15, similar to steps 11 and 13 hereinbefore, the other feeder statuses are set to zero and the map of cars on emergency power is established as the cars on the feeder 2 and the number of cars to be recovered is set equal to the number of cars being fed by feeder 2. After two passes through FIG. 8, test 14 is affirmative and the program will advance. Whenever one feeder failure condition exists, either one of two feeders failing or the only feeder failing, for two successive cycles, either tests 10, 12 or 14 will be affirmative causing a test 16 to be reached. But, if first only feeder 1 fails and its status has advanced, and subsequently feeder 2 is determined to have failed, then eventually test 10 will be reached before test 12 will be satisfied. This two-cycle delay ensures that the car controllers on the failed one or two feeders are properly brought to emergency power operation (FIG. 2) before the feeder failure status is acted upon in the group controller.

In FIG. 8, once two cycles of the same feeder failure status have occurred, a test 16 determines whether feeder 2 has failed or not. If it has, a test 17 determines if there are two failure indicators in the particular elevator system involved. In some cases, the customer may desire only one indicator to indicate some power failure, regardless of whether a split feeder is involved or not. In other cases, the customer may desire to have an indicator for each of the feeders. If there is only one indicator for two feeders, test 17 will be negative and the emergency power indicator 1 will be set in a step 18 (in such case this is the only indicator in the system). But on the other hand, if feeder 2 has failed and two indicators are involved, both tests 16 and 17 will be affirmative so that only emergency power indicator 2 will be set in a step 19. If feeder 2 has not failed, test 16 will be negative. In the event that test 16 is affirmative and two indicators are involved, or test 16 is negative, a test 20 will determine if feeder 1 has failed. If it has, it will cause emergency power indicator 1 to be reset by step 18. When the indicators have been properly set, a step 21 will reset the normal power indicator of the group controller 17 (FIG. 1). Then, the group status condition of whether or not all cars have been returned or delayed (recovery has been attempted for all cars) is interrogated in a test 22. If test 22 is negative, phase one operation is reached through a transfer point 23; but if test 22 is affirmative (an attempt has been made to recover all of the cars), then the group emergency power return routine will advance to phase two operation through a transfer point 24.

In phase one operation, the group selects the cars one at a time for recovery to the designated emergency landing. The phase one portion of the group emergency power routine is reached through an entry point 1 in FIG. 9. A first test 2 determines if there is a split feeder. If there is, a test 3 determines if both feeders have failed. If no feeder is available, either test 2 will be negative or test 3 will be affirmative and a pair of steps, 4, 5 will reset all hall calls and inhibit scanning of further hall calls so that the group controller (17, FIG. 1) will not attempt to allocate hall calls for assignment to elevators. But if only one of two feeders has failed, those cars which are still on normal power can react to assignment of hall calls and therefore the hall calls are not reset and inhibited.

Figure 9:
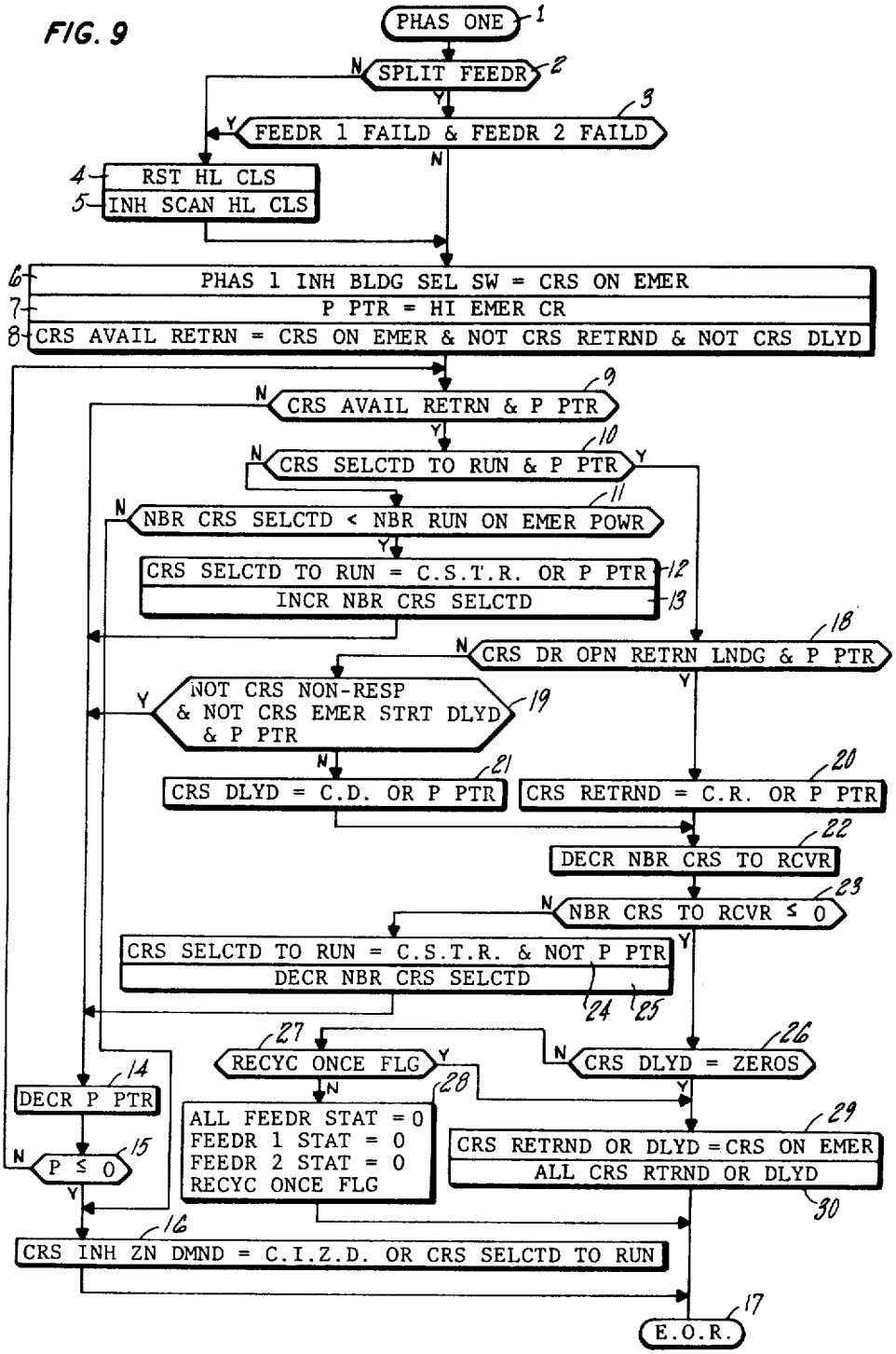

In FIG. 9, a step 6 causes the phase one inhibit of the building select switch (that which is interrogated in test 12 of FIG. 2 in each of the cars) to be established in a map equal to the map of cars on emergency power (which is set in an appropriate one of the steps 11, 13, 15, FIG. 8, to relate to those cars on failed feeders only). This map must be reset to all zeros automatically in each cycle so as to be again set only in phase one cycles. If not reset in cyclic housekeeping routines, it could be reset at step 21 of FIG. 8. Then a step 7 sets a P pointer (this is a word containing one bit for each car, the bit of the car currently under consideration being a ONE, and the remaining bits being a zero) equal to the highest numbered car of the cars which are to be considered under group control during emergency power operation. This may include more than the number of cars normally included within group control in the case where one elevator is for special use only. But if there is no distinction, this would simply be the highest numbered car in the group. A step 8 then sets a map of cars available to be returned as the logical AND of those cars on emergency (on the failed feeder), the complement of cars which have been returned and the complement of cars which are delayed. Thus any car assigned to the failed feeder which has not been returned or delayed will be in the map of cars available to return (to recover the first time). Initially, this map will include all the cars on the failed feeder.

In FIG. 9, a step 9 compares the map of cars available to return with the P pointer to see if the car under consideration is available to be returned. If it is, a test 10 determines if this car has already been selected to be run. Initially, no cars are selected to be run so that test 10 will be negative and reach a test 11 wherein the word containing the number of cars selected to run is compared to see if it is less than a stored number indicating how many cars can run on emergency power. This number may vary from one to several, depending upon the magnitude of the emergency power supply, and the power requirements of the elevators in the system. For purposes of description herein, it is assumed that more than one car can run on emergency power, thus illustrating full utilization of the present invention. Initially, no cars have been selected so that test 11 will be affirmative reaching a step 12 wherein the map of cars selected to run is updated by ORing with the P pointer so that the car under consideration has now become a car selected to run. And a step 13 will increment the number of cars selected.

In FIG. 9, once a car has been considered, a step 14 (lower left of FIG. 9) will decrement the P pointer so as to cause consideration of the next lower numbered car. Then a test 15 determines if all cars have been considered. If not, test 9 is repeated for the next car in the sequence. Assuming that two cars can run on emergency power, step 11 will again be affirmative and the car currently in consideration will be added to the map of cars selected to run. Then step 14 will be repeated and test 15 will determine that all cars have not yet been considered, causing test 9 to be repeated. For the third car under consideration, test 10 will initially be negative causing test 11 again to be reached. But if only two cars can be run on emergency power, and two have been assigned, test 11 will be negative this time, causing the program to advance to a step 16 in which a map of cars having zone demand inhibited is updated by ORing with the map of cars which are selected to run under phase one (a recovery phase wherein no zone control over the cars is permitted). Then other parts of the program of the microprocessor within the group controller 17 (FIG. 1) are reverted to through an end of routine point 17. In a subsequent cycle, passing through FIG. 9, assuming that the two cars previously selected have not yet reached the return landing, the tests and steps 2-8 will be performed as described hereinbefore. Test 9 will be affirmative since the two selected cars (including the highest car) are still available to be returned. But test 10 will be affirmative because the highest numbered car was selected to run in a previous cycle. This will cause a test 18 to determine if the particular car in question (here assumed to be the highest numbered car) is in the map of cars having their doors opened at the return landing one time (cars which have successfully been recovered). If the car in question has not yet reached the return landing, test 18 will be negative causing a test 19 to determine if the car is non-responsive or if the car is one which has been determined to be delayed. The map of cars which are determined to be non-responsive is a map of cars concerning which communications between the group controller 17 and the related car controller 15, 16 (FIG. 1) have failed. That is, the normal microprocessor handshake procedure has indicated that normal communication of words between the microprocessors is not functioning properly. The map of cars having emergency start delayed is a map of cars within which the delayed status has been established in step 14 of FIG. 4, and this status has been communicated from the corresponding car controller (15, 16) to the group controller (17, FIG. 1). But if this particular car in consideration has not yet been determined to be delayed, test 19 will be affirmative since the complement of these maps are tested. This will cause further consideration of this car to be bypassed by proceeding to step 14 which decrements the P pointer to consider the second highest numbered car in the emergency group. Assuming the second highest numbered car has also been selected in a previous cycle, this will cause the tests 9, 10, 18 and 19 to be performed in the same fashion for the second car in the sequence, and the third car will then be selected by decrementing the P pointer in step 14. This will cause step 9 to be affirmative for the third car, step 10 will be negative, and step 11 will be negative because (assuming only two cars can be selected) two cars have already been selected. Therefore, the program will advance to step 16 as in the first cycle. Eventually, assuming one of the cars does reach the return landing, step 18 in FIG. 9 will be affirmative for that car, so that car will be added to the map of cars returned by ORing with the P pointer in a step 20. On the other hand, one of the first two selected cars may be delayed or may have become non-responsive due to a failure of communication. In such a case, step 18 would still be negative (since the delayed or non-responding car will not have reached its landing) but test 19 will also be negative causing a step 21 to update a map of delayed cars by ORing with the P pointer. In either of these cases, the car is either returned or delayed and not to be given further consideration. Thus, after either step 20 or 21, a step 22 will decrement the number of cars left to be recovered (or attempted to be recovered). Note that the group controller uses the map of cars delayed set in step 21 to determine eligibility during phase one. Therefore, resetting of delayed status (10, FIG. 3) will not alter the car's phase one eligibility. Until all of the cars to be recovered have either been returned or determined to be delayed or non-responsive, a test 23 will indicate that the number of cars left to be recovered is greater than zero. This causes a negative result of test 23 which causes a step 24 to update the map of cars selected to run so as to exclude the car currently in question (since it was either determined to have been returned by test 18 or to be delayed by test 19), by ANDing with a complement of the P pointer. And a step 25 will decrement the number of cars selected to run. Then step 14 is reached to decrement the P pointer so as to allow consideration of the next car in the sequence. Thus, whenever cars are determined to be returned or delayed, another car can be tried for recovery.

Eventually, in subsequent passes through the program portion of FIG. 9, all of the cars will have had a chance to be recovered. The number of cars to recover will therefore have been decremented to zero in step 22 so that test 23 will be affirmative. If in this process, one or more cars were not actually recovered, then a test 26 will be negative because the map of delayed cars will not be all zeros. This will cause a test 27 to determine if a once-only, recycle once flag has been set or not. Initially, it will not be set so that a negative result of test 27 will cause steps 28 to be reached which reset the feeder statuses and then set the recycle once flag. With the feeder statuses reset, subsequent passes through the second portion of the group emergency power routine illustrated in FIG. 8 will cause a significant portion of the statuses and maps to be reset to zeros. However, the map of cars with their door open at the return landing it not reset to zeros, and still reflects all of the cars for which the door open at return landing status has been set in step 21 of FIG. 6. This will cause the phase 1 routine of FIG. 9 to begin as initially described hereinbefore, with all of the cars being available to be returned that are on the feeder. However, after each car is selected to run by step 12, in the next subsequent cycle (the next pass through FIG. 9) such car will cause an affirmative result of test 18 so that the map of cars returned is updated in step 20 after a number of cycles which is something less than the number of cars under consideration. Thus on the order of a second or so will pass before only the unrecovered cars will be given consideration in FIG. 9 during the recycle once portion of phase one. When in the recycle portion all of the cars have been given consideration again, step 26 is again reached. If in fact some car still has delayed status (being unrecoverable), test 26 will again be negative but since the recycle once flag has been set, test 27 will be affirmative. Thus whether or not all cars were in fact recovered during the recycle once portion of phase one, in a step 29, a map of cars returned or delayed is set equal to the map of cars on emergency (the cars on the failed feeder or feeders) which is utilized to transmit, to all of the cars in that map, the fact that all of the cars have been returned or delayed, for use in test 9 of FIG. 3 within the microprocessor of each of the car controllers 15, 16 (FIG. 1). And, a single status bit equal to the same thing, indicating all cars have been returned or delayed, is set in a step 30 of FIG. 9, for use in test 22 of the second portion of the group emergency power routine of FIG. 8 as described hereinbefore. And then, other parts of the microprocessor program are reached through the end of routine point 17.

Notice that in FIG. 9, in each cycle, after as many cars as can be, have been selected to run (including the fact that some are deselected and others are replaced), step 16 will inhibit zone demand for that cycle of those cars which are selected to run. Zone demand is reestablished in each cycle because it is reset (elsewhere) in each cycle. Alternatively, the map of cars to have their zone demand inhibited could be reset at the start of the group emergency power routine, if desired, such as in FIG. 7 or near step 21 of FIG. 8.

Figure 10:
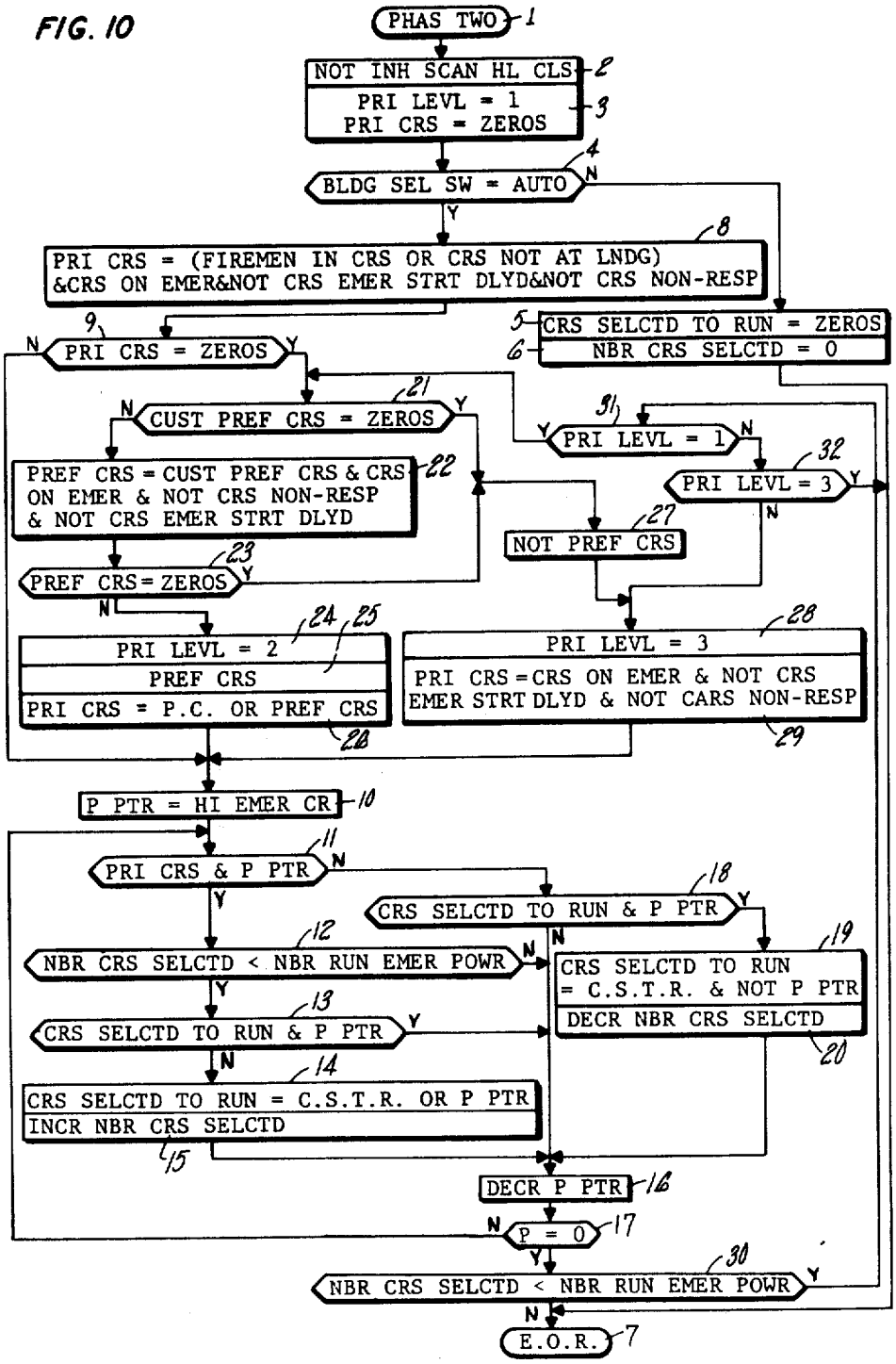

Once an attempt has been made to recover each of the cars which are on the failed feeder, and the all cars returned or delayed status has been set in step 30 of FIG. 9, subsequent passes through the group emergency power routine will reach test 22 of FIG. 8 and find that it is affirmative, causing the program to proceed through the transfer point 24 to the phase two portion of the program, which is reached through an entry point 1 in FIG. 10. Then a step 2 will reset the inhibit scan hall calls status so that hall calls can be scanned by the group controller. This is because during phase two one or more cars may be operated (except during the periof of time when all of the unrecoverable cars are utilizing all of the available power on re-try) in order to service calls in the building. And a pair of steps 3 set a priority level equal to 1 and a map of priority cars to all zeros, for purposes described hereinafter.

In FIG. 10, a test 4 determines if the building select switch has been set to automatic or not. If not, a negative result of test 4 indicates that the group cannot select cars to run on phase two to provide service to the building, because an attendant desires to designate the cars by means of the building select switch (such as at the lobby panel 21, FIG. 1). This will cause a step 5 to cause the map of cars selected to run to be all zeros and the number of cars selected to be zero in a step 6. That is the only function performed in such a case, and other parts of the program of the microprocessor within the group controller 17 (FIG. 1) are reached through an end of routine point 7. In the event that the particular elevator system is not provided with automatic group control for emergency power, there will be no permitted automatic selection point on the building select switch, so that test 4 will always be negative.

In the general case, utilizing the invention to its full extent, test 4 in FIG. 10 will typically be affirmative. This will cause a step 8 to set an initial map of priority cars equal to cars in which the fireman is present in the car and has taken over control of the car, or cars which are not at the designated emergency landing (a map of cars which have caused, at step 17 of FIG. 4, their own car not at landing status to have been set). In addition, any of the cars not at the landing or having a fireman therein must also be cars on emergency, not delayed and not non-responsive, due to the ANDing of appropriate maps therewith. Thus, as a first consideration, step 8 causes a map of priority cars to be those cars with firemen or not at landing which are connected to the failed feeder or feeders and are not delayed or non-responsive. Note that the delayed status is determined from the map of cars with emergency start delayed, which is updated directly from each car (14, FIG. 4; 10, FIG. 3). Therefore, the car becomes eligibly non-delayed in response to its re-try timer (FIG. 3).

In FIG. 10. a test 9 determines if there are any priority cars established in step 8. If there are, then the map will not be all zeros and a negative result of step 9 will cause the second part of the phase two process to commence. In a step 10 the P pointer is set equal to the highest emergency car (the highest car in the group during emergencies, whether it is on the failed feeder or not). Then a test 11 determines if the car under consideration is within the map of priority cars. If it is, a test 12 determines if the number of cars selected is less than the number which can be run on emergency power. If it is, the map of cars selected to run is examined to see if this car has previously been selected to run in a test 13. If it has not, then the car is selected to run by updating the map of cars selected to run by ORing with the P pointer in a step 14 and the number of cars selected is incremented in a step 15. Thereafter, a step 16 will decrement the P pointer so as to designate the next lower numbered car and a test 17 determines if all cars have been tested or not. Initially, not all cars have been tested so the program reverts to test 11 to determine if the car in question is a priority car. If it is not, then a test 18 will determine if the car has previously been selected to run. If it has, but is is not a priority car, an affirmative result of test 18 will reach a step 19 which causes the map of cars selected to run to be updated by deleting the car in question, which is effected by ANDing with the complement of the P pointer. And the number of cars selected is decremented in a step 20. Then the P pointer is again decremented in step 16, and test 17 is made to determine if all cars have been tested or not.

In FIG. 10, if the car under consideration (designated by the P pointer) is a priority car but the number of cars selected is no longer less than the permitted number to run, step 12 will be negative and nothing further will happen with respect to that car. If the car under consideration is not a priority car, but the car has not previously been selected to run, tests 11 and 18 are both negative and nothing further happens with respect to that car. Thus, the second half of the phase two portion simply tries to select priority cars for running, and delete those which are not priority cars, keeping the number of cars selected equal to or less than the number which are allowed to run on emergency power.

In FIG. 10, following step 8, if test 9 determines that there are no priority cars for assignment, then a test 21 will determine if there are any customer preferred cars by examining a map of customer preferred cars to see if it is all zeros. Each car in the map of customer preferred cars also has a status bit indicating that it is preferred, for use in test 24 of FIG. 4. If there is one or more cars designated as preferred by the customer (as indicated in a map in storage), a negative result of test 21 will cause a step 22 to set a map of preferred cars equal to the map of customer preferred cars ANDed with cars on emergency (fed by the failed one or more feeders) and cars which are neither delayed nor non-responsive, in a fashion analogous to step 8. If there is a customer preferred car on the failed feeder which is neither delayed nor non-responsive, then a test 23 will be negative and a step 24 will set the priority level number equal to 2. A step 25 will set a status flag indicating that there are qualified preferred cars (which flag is interrogated in test 25 of FIG. 4) and the map of priority cars is updated by ORing it with the map of preferred cars. Then, during the second priority level, assignment of cars to run during phase two is made through steps and tests 10-17 as described hereinbefore. Note that use of non-fireman, non-preferred cars is permitted, but such cars are always urged to the lobby (FIG. 4) so as to lose their priority status in step 8 (FIG. 10) to permit searching for a qualified (not delayed) preferred car in step 22. Thus the system inherently trends toward use of preferred cars.

In FIG. 10, if tests 9 and 21 determine that there are no cars with firemen in them or cars not at landings and no customer preferred cars, then a step 27 will ensure that the preferred cars status is reset. This step can also be reached by an affirmative result of step 23 indicating that although the customer has designated some preferred cars, none of them are available (qualified) for assignment. Following step 27, a step 28 will set the priority level equal to 3, and the map of priority cars is indicated as being any car on emergency (any car on the failed one or more feeders) which is not delayed or non-responsive.

Following step 29 of FIG. 10, the steps and tests 10–17 are repeated in order to attempt to select cars to run in the third priority level of phase 2. Each time that the map of priority cars is updated in one of the successive priority levels (step 8 and test 9 in priority level 1, step 22 and test 23 in the second priority level, and following step 29 in the third priority level) when all the cars have been tested as indicated by an affirmative result of test 17, a test 30 determines whether a sufficient number of cars have been selected or not. If test 30 is negative, this means that more cars can be selected to run than have been thus far. A negative result of test 30 causes a test 31 to determine if priority level 1 is current. If it is, priority level 2 is attempted by an affirmative result of test 31 reaching test 21. But if priority level 1 is not involved (meaning that it is either priority level 2 or priority level 3), a negative result of test 31 will reach a test 32 that determines whether priority level 3 is involved. If priority level 2 is current, a negative result of test 32 will cause step 28 to be reached to establish priority level 3. But once priority level 3 is current, an affirmative result of test 32 will cause the program to revert through the end of routine point 7. In other words, determining the selection of cars in each of three priority levels until all three levels have been attempted or until the number of cars selected equals the number which can be run on emergency power (as indicated in test 30) constitutes operation of phase two. During the highest priority level, step 8 gives precedence to cars with firemen in them as well as to cars not at landings. This means that any car which is operating in phase two and is not at the return landing can be a car selected to run until it reaches its return landing, in a fashion described with respect to phase two operation of the car at test 26 in FIG. 4. Thus, whenever the car is away from its landing it continues to have permission to operate by virtue of being a priority car as set in step 8 of FIG. 10. And in FIG. 10, if the second priority level has not been reached with customer preferred cars established as priority cars (or as some of the priority cars), then it is known that priority level 3 will be reached so that each individual car controller (FIG. 4) is allowed to continue to run by virtue of the negative result of test 25 (FIG. 4). But if the car in question is operating during phase two without a fireman in its car, and it is not a preferred car, and the second priority level is reached by the group controller (FIG. 10), then the affirmative result of step 25 (FIG. 4) will force the car to give up its selection status by causing it to return to the designated return landing, thereby allowing another car to be selected.

Notice that, in the phase two portion of the routine illustrated in FIG. 10, there may be one fireman car, one customer preferred car and any other car, each being selected from a different one of the priority levels (in a case where three cars may be permitted to run). The priority levels simply establish the preferential basis upon which cars are to be selected to run, and are exclusive only to the extent that one of the higher priority levels will be assured selection whereas the lower levels will be selected only in the event that there is a capability to run more cars than those selected at the higher priority level.

A first and simple aspect of the invention is the fact that the group control during phase one (during an initial attempt to bring all the cars down in a recovery procedure) is repeated immediately, in any case in which not all cars are recovered in the first attempt to recover each of the cars. This is as a consequence of the steps 28 at the bottom of FIG. 9 resetting the statuses, which are utilized in FIG. 8 to require two cycles of initialization within which the number of cars to recover is established as the number of cars on the failed feeder. And in FIG. 9, this will cause the car selection process to repeat through all of the cars until test 23 indicates that there are no further cars to recover or attempt to recover. As a consequence, the opportunity for cars to be recovered and passengers to rapidly escape therefrom is increased because, having recovered as many cars as can be, the group then attempts to recover those cars which were not successfully recovered in original pass through phase one group control operation. Were it not for this recycling (a second attempt at recovering any delayed cars), the passengers therein would have to wait until service to passengers by other cars were initiated and then interrupted in accordance with the inventive procedures utilized herein in phase two. Of course, in prior art systems, after a single attempt to recover cars, no further attempt is made by a group controller (only operator intervention at a control panel could make further attempts to recover the cars on emergency power).

A second significant aspect of the invention is utilization of priority levels for car selection as described at the top of FIG. 10. Since any car not at a landing has a highest priority level, those cars which are providing service to passengers but are away from the designated landing continue to have operational priority so that the service can be provided. But, as is described with respect to phase two operation in FIG. 4, each car controller will tend to force a call call to the return landing unless it is carrying a fireman or it is a preferred car or there are no other qualified preferred cars. Thus, the cars providing service which are not preferred cars will tend to return to the landing so that more preferred cars or delayed cars can be selected as necessary. In the case of only preferred cars providing service when there is still a delayed car, normal group control may provide for forcing lobby calls whenever there is no car in the group headed toward the lobby, in a known manner. In such case, test 25 of FIG. 4 can be eliminated. Thus, it will not be mere chance that even preferred cars which are providing service will ultimately reach the lobby and therefore lose their priority status. This will permit an unrecovered car (not at a landing) to be selected (step 8, FIG. 10) as a consequence of resetting its emergency start delayed status as a consequence of its re-try timer time-out at test 17 in FIG. 3. This provides an orderly way to permit re-trying the recovery of an as-yet unrecovered car without causing disruption of passenger service. Obviously, if when the re-try timer timed out, the unrecovered car was automatically given operational status to the detrement of any other car which had been selected to provide passenger service, then the other car would become stopped at some point in the building and the passengers therein would have to be rescued as well. Thus it is that the priority levels herein not only aid in achieving a principal objective of the invention (the automatic re-trying to recover cars during curtailed operation in phase two), but also tends to substitute preferred cars for non-preferred cars as they become available (the delaying condition is removed and the cars are returned to the designated landing).

Of course, various aspects of the invention can be achieved in a slightly different way without using all of the aspects of the invention. And, although the invention is shown in terms of unique routines which are readily implementable by ordinary programming of a wide variety of computers which may be selected for use within the group controller 17 (FIG. 1) and the car controllers 15, 16 (FIG. 1), it should be obvious that dedicated digital hardware, relay logic, or combinations of them may be utilized to perform the same functions as those performed by the controller microprocessors in accordance with the logic flow diagrams illustrated herein.

Similarly, although the invention has been shown and described with respect to exemplary embodiments thereof, it should be understood by those skilled in the art that the foregoing and various other changes, omissions and additions in the form and detail thereof may be made therein and thereto, without departing from the spirit and the scope of the invention.

I claim:

1. An elevator system including a group controller means and a plurality of elevators operable either in response to normal electrical power provided by a feeder or in response to emergency electrical power in the absence of normal power at said feeder;

each elevator including a car movable between landings of a shaftway in a building, motion means for providing and arresting motion of the related car in its shaftway, and car controller means, for registering requests for service to said landings, for providing car control signals indicative of said requests for service and of conditions of said car, and for controlling said motion means and providing access between said car and said landings in response to said car control signals, for monitoring said feeder and for providing in response to loss of power at said feeder and to a signal indicative of said group controller selecting said elevator to run, signals to said motion means to cause said car to approach and provide access to said designated landing and either a first signal indicative of providing access to said designated landing or a second signal indicative of failure to provide access to said designated landing after a determined time period;

said group controller means comprising means for exchanging signals with each of said car controller means, for monitoring said feeder and providing, to said car controller means, in response to loss of normal power at said feeder, select signals indicative of successive ones of said elevators selected to run on emergency power to recover said elevators to a designated landing, the select signal for each elevator ending in response to receipt of either said first signal or said second signal from the related car controller means, for providing a phase two signal in response to receipt from each of said car controller means of either said first signal or said second signal, and for providing to at least one of said car controller means said select signal indicative of the related elevator being designated to run in response to said phase two signal; characterized by:

each of said car controller means comprising means for providing a third signal indicative of the related car not being at said designated landing, responsive to the absence of said select signal for rendering the related elevator inoperative, responsive to concurrence of said second signal and said phase two signal for a given time interval to cease providing said second signal, and responsive to the absence of said first signal concurrently with the presence of said select signal to cause said car to approach and provide access to said designated landing; and said group controller means comprising means responsive to the absence of said second signal concurrently with the presence of said third signal from the same one of said car controller means and said phase two signal for providing a select signal to said one car controller means, whereby any car not recovered prior to provision of the phase two signal may be periodically selected to run in an attempt to recover the car to the designated landing after provision of the phase two signal.

2. An elevator system including a group controller means and a plurality of elevators operable either in response to normal electrical power provided by a feeder or in response to emergency electrical power in the absence of normal power at said feeder;

each elevator including a car movable between landings of a shaftway in a building, motion means for providing and arresting motion of the related car in its shaftway, and car controller means, for registering requests for service to said landings, for providing car control signals indicative of said requests for service and of conditions of said car, and for controlling said motion means and providing access between said car and said landings in response to said car control signals, for monitoring said feeder and for providing in response to loss of power at said feeder and to a signal indicative of said group controller selecting said elevator to run, signals to said motion means to cause said car to approach and provide access to said designated landing and either a first signal indicative of providing access to said designated landing or a second signal indicative of failure to provide access to said designated landing after a determined time period;

said group controller means comprising means for exchanging signals with each of said car controller means, for monitoring said feeder and providing, to said car controller means, in response to loss of normal power at said feeder, select signals indicative of successive ones of said elevators selected to run on emergency power to recover said elevators to a designated landing, the select signal for each elevator ending in response to receipt of either said first signal or said second signal from the related car controller means, for providing a phase two signal in response to receipt from each of said car controller means of either said first signal or said second signal, and for providing to at least one of said car controller means said select signal indicative of the related elevator being designated to run in response to said phase two signal; characterized by:

each of said car controller means comprising means responsive to the absence of said phase two signal concurrently with the absence of said select signal to cease providing said second signal; and said group controller means comprising means responsive to receipt of said second signal from at least one of said car controller means and receipt of either said first signal or said second signal from each other one of said car controller means for providing a recycle signal, responsive to said recycle signal for providing, to successive ones of said car controller means from which said first signal has not been received, select signals to direct the related elevators to run on emergency power to recover said elevators to said designated landing, and responsive to receipt of either said first signal or said second signal from each of said car controller means during the presence of said recycle signal for providing said phase two signal, whereby a first unsuccessful attempt to recover all cars results in a second attempt to recover cars before providing select signals in response to said phase two signal.

3. An elevator system including a group controller means and a plurality of elevators operable either in response to normal electrical power provided by a feeder or in response to emergency electrical power in the absence of normal power at said feeder;

each elevator including a car movable between landings of a shaftway in a building, motion means for providing and arresting motion of the related car in its shaftway, and car controller means, for registering requests for service to said landings, for providing car control signals indicative of said requests for service and of conditions of said car, and for controlling said motion means and providing access between said car and said landings in response to said car control signals, for monitoring said feeder and for providing in response to loss of power at said feeder and to a signal indicative of said group controller selecting said elevator to run, signals to said motion means to cause said car to approach and provide access to said designated landing and either a first signal indicative of providing access to said designated landing or a second signal indicative of failure to provide access to said designated landing after a determined time period;

said group controller means comprising means for exchanging signals with each of said car controller means, for monitoring said feeder and providing, to said car controller means, in response to loss of normal power at said feeder, select signals indicative of successive ones of said elevators selected to run on emergency power to recover said elevators to a designated landing, the select signal for each elevator ending in response to receipt of either said first signal or said second signal from the related car controller means, for providing a phase two signal in response to receipt from each of said car controller means of either said first signal or said second signal, and for providing to at least one of said car controller means said select signal indicative of the related elevator being designated to run in response to said phase two signal; characterized by:

said car controller means comprising means for providing a third signal indicative of the related car not being at said designated landing; and said group controller means comprising means for providing, in response to said phase two signal, said select signals, to a predetermined number of said elevators which can run simultaneously on emergency power and are not providing said second signal to said group controller means, on a priority basis of which the highest priority includes those elevators providing said third signal to said group controller means.

4. An elevator system according to claim 3 characterized by said group controller means comprising means for providing preferred signals indicative of any elevator predetermined to be preferred for operation on emergency power, for providing said select signals on a priority basis of which the highest priority includes those elevators providing said third signal to said group controller means, if any, and a lower priority includes an elevator indicated by said preferred signals.

5. An elevator system according to claim 4 characterized by said group controller means comprising means for providing said select signals on a priority basis of which the lowest priority includes any other one of said elevators.

6. An elevator system according to claim 4 characterized by said car controller means comprising means for providing a fireman signal to said group controller means indicative of the related elevator being on fireman service, and said group controller means comprising means for providing said select signals on a priority basis of which the highest priority includes those elevators providing said fireman signal to said group controller means.

7. An elevator system according to claim 6 characterized by said group controller means comprising means for providing said select signals on a priority basis of which the lowest priority includes any other one of said elevators.

8. An elevator system according to claim 7 characterized by said car controller means comprising means responsive to concurrent absence of both said fireman signal and one of said preferred signals provided by said group controller means designating the corresponding elevator as preferred and presence of at least one of said preferred signals and said phase two signal for providing signals to the related motion means to force said car to said designated landing.

9. An elevator system according to claim 5 characterized by said car controller means comprising means responsive to concurrent absence of one of said preferred signals provided by said group controller means designating the corresponding elevator as preferred and presence of at least one of said preferred signals and said phase two signal for providing signals to the related motion means to force said car to said designated landing.

10. An elevator system according to claim 3 characterized by said car controller means comprising means responsive to the absence of said select signal for rendering the related elevator inoperative, responsive to concurrence of said second signal and said phase two signal for a given time interval to cease providing said second signal, and responsive to the absence of said first signal concurrently with the presence of said select signal to cause said car to approach and provide access to said designated landing.

* * * * *